US005270153A

United States Patent [19]

Suzuki et al.

[11] Patent Number: 5,270,153

[45] Date of Patent: Dec. 14, 1993

[54] CYAN IMAGE FORMING METHOD AND SILVER HALIDE COLOR PHOTOGRAPHIC MATERIAL CONTAINING CYAN COUPLER

[75] Inventors: Makoto Suzuki; Tadahisa Sato; Kozo Sato; Yoshio Ishii, all of Kanagawa, Japan

[73] Assignee: Fuji Photo Film Co., Ltd., Kanagawa, Japan

[21] Appl. No.: 797,977

[22] Filed: Nov. 26, 1991

[30] Foreign Application Priority Data

Nov. 28, 1990 [JP] Japan ..... 2-326218
Aug. 26, 1991 [JP] Japan ..... 3-236894

[51] Int. Cl.[5] ..... G03C 7/38

[52] U.S. Cl. ..... 430/384; 430/385; 430/558

[58] Field of Search ..... 430/558, 384, 385

[56] References Cited

U.S. PATENT DOCUMENTS 4,910,127 3/1990 Sakaki et al. ..... 430/546
5,091,297 2/1992 Fukunaga et al. ..... 430/558

FOREIGN PATENT DOCUMENTS 2278552 12/1987 Japan ..... 430/558
3141057 6/1988 Japan ..... 430/558
3264755 11/1988 Japan ..... 430/558

*Primary Examiner*—Lee C. Wright
*Attorney, Agent, or Firm*—Sughrue, Mion, Zinn, Macpeak & Seas

[57] ABSTRACT

A silver halide color photographic material comprising a support having thereon at least one light-sensitive silver halide emulsion layer containing at least one 1H-pyrrolo[2,1-c][1,2,4]triazole cyan coupler represented by the following general formula (I) or (II):

(I)

(II)

wherein $R_1$, $R_2$ and $R_3$ each represents a hydrogen atom or a substituent, provided that at least one of $R_1$ and $R_2$ is an electron withdrawing group which has a Hammett's substituent constant $\sigma p$ value of 0.15 or more; $R_1$ and $R_2$ may be bonded to form a ring; and X represents a hydrogen atom or a substituent capable of being released upon coupling with an oxidation product of an aromatic primary amine color developing agent; said coupler may form a bis-compound or or a polymer at $R_1$, $R_2$, $R_3$ or X; and a cyan image forming method comprising imagewise exposing a silver halide color photographic material comprising a support having thereon at least one light-sensitive silver halide emulsion layer and subjecting the exposed photographic material to color development with an aromatic primary amine color dveloping agent at the presence of the above-described 1H-pyrrolo[2,1c][1,2,4]triazole cyan coupler.

30 Claims, 1 Drawing Sheet

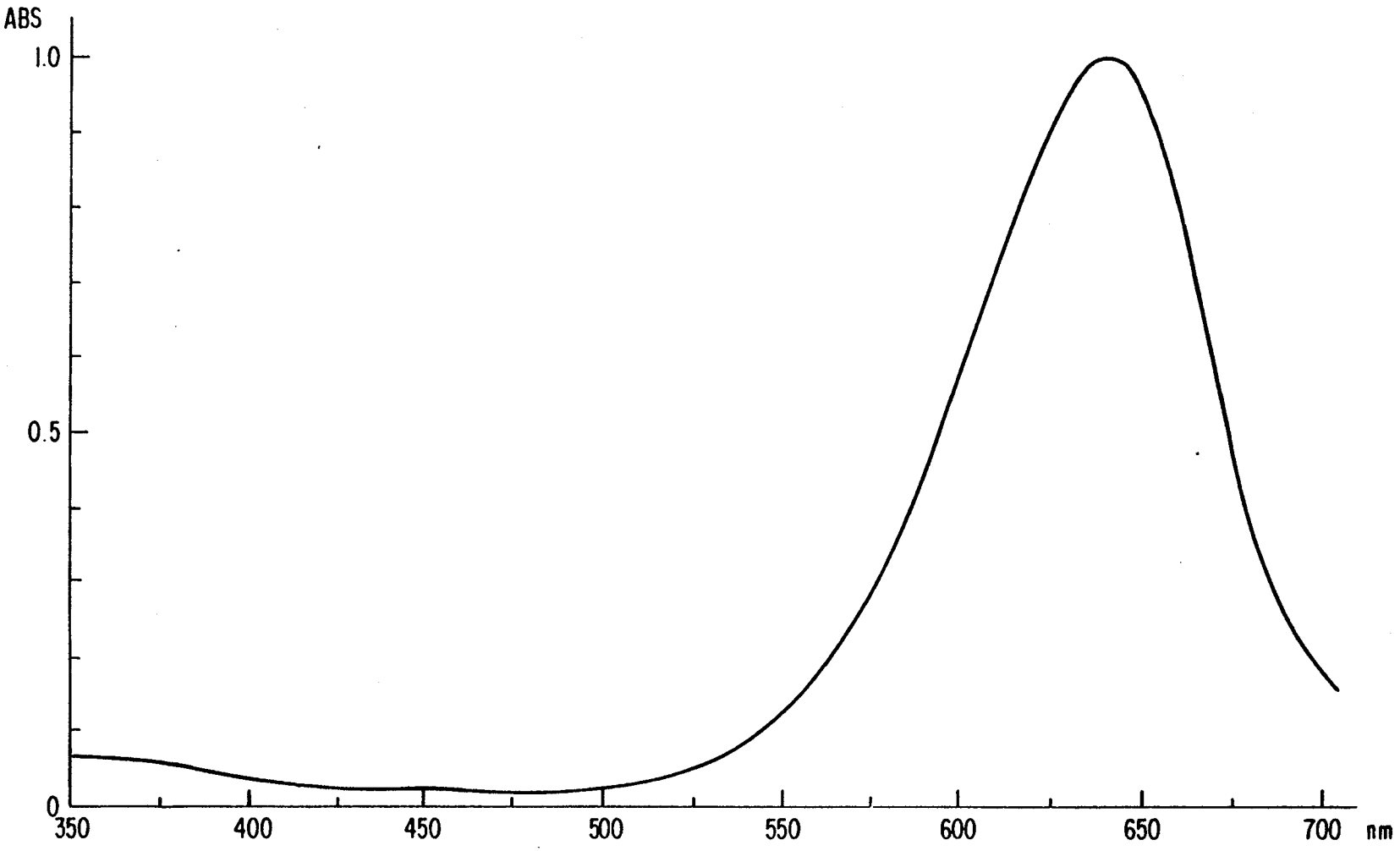
ABS
1.0
0.5
0
350
400
450
500
550
600
650
700
nm

CYAN IMAGE FORMING METHOD AND SILVER HALIDE COLOR PHOTOGRAPHIC MATERIAL CONTAINING CYAN COUPLER

FIELD OF THE INVENTION

The present invention relates to a cyan image forming method using an 1H-pyrrolo[2,1-c][1,2,4]triazole cyan coupler having improved color forming property, color reproducibility and image preservability and a silver halide color photographic material containing the cyan coupler.

BACKGROUND OF THE INVENTION

It is well known that an aromatic primary amine color developing agent oxidized with exposed silver halide reacts with a coupler to form a dye such as an indophenol, an indoaniline, an indamine, an azomethine, a phenoxazine, a phenazine or a like dye, whereby a color image is formed. In this photographic system, the subtractive color process is ordinarily employed for color reproduction and color images are formed by yellow, magenta and cyan dyes.

In order to form cyan color images, phenolic or naphtholic couplers are generally employed. However, these couplers have a serious problem in that color reproducibility is remarkably deteriorated because dyes formed therefrom have an undesirable absorption in the green region. Accordingly, it has been desired to solve this problem.

In order to solve this problem, 2,4-diphenylimidazoles are disclosed in European Patent 249,453 A3. These couplers are preferred from the standpoint of color reproduction since they provide dyes which have a small amount of undesirable absorption on the shorter wavelength side in comparison with conventional dyes.

However, the couplers as described in European Patent 249,453 A3 have some disadvantages in practical use because they have still insufficient color reproducibility, in that they have a low coupling activity, and because the dyes formed therefrom have very poor fastness to heat and light.

Pyrazoloazole couplers as described in JP-A-64-552, JP-A-64-553, JP-A-64-554, JP-A-64-555, JP-A-64-556 and JP-A-64-557 (which correspond to U.S. Pat. No. 4,873,183) have improved undesirable absorption on the shorter wavelength side as compared with conventional dyes. However, their color forming property and color reproducibility are insufficient as cyan couplers.

SUMMARY OF THE INVENTION

Therefore, an object of the present invention is to provide a cyan dye image having a small subsidiary absorption.

Another object of the present invention is to provide a silver halide color photographic material containing a novel cyan coupler which can form a cyan dye having a small subsidiary absorption.

A still another object of the present invention is to provide a cyan image forming method with excellent color forming properties, color reproducibility and image preservability.

A further object of the present invention is to provide a silver halide color photographic material with excellent color forming properties, color reproducibility and image preservability.

Other objects of the present invention will be apparent from the following detailed description and examples.

As a result of intensive investigations to solve the above described problems, it has been found that the above described objects are accomplished by pyrrolotriazole coupler having a specific substituent on the 1H-pyrrolo[2,1-c][1,2,4]triazole nucleus.

More specifically, the above described objects are accomplished by (1) a cyan image forming method comprising imagewise exposing a silver halide color photographic material comprising a support having thereon at least one light-sensitive silver halide emulsion layer and color developing the exposed material with an aromatic primary amine color developing agent at the presence of an 1H-pyrrolo[2,1-c][1,2,4]triazole cyan coupler represented by the general formula (I) or (II), and (2) a silver halide color photographic material comprising a support having thereon at least one light-sensitive silver halide emulsion layer containing at least one 1H-pyrrolo[2,1-c][1,2,4]triazole cyan coupler represented by the general formula (I) or (II):

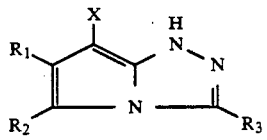

(I)

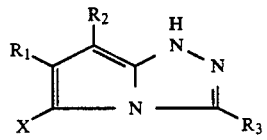

(II)

wherein $R_1$, $R_2$ and $R_3$ each represents a hydrogen atom or a substituent, provided that at least one of $R_1$ and $R_2$ is an electron withdrawing substituent which has a Hammett's substituent constant $\sigma p$ value of 0.15 or more; and X represents a hydrogen atom or a substituent capable of being released upon coupling with an oxidation product of an aromatic primary amine color developing agent.

1H-pyrrolo[2,1-c][1,2,4]triazole cyan couplers are disclosed in JP-A-62-278522 and U.S. Pat. No. 4,910,127. However, couplers disclosed in these references form magenta dyes. It was unexpected that when at least one of $R_1$ and $R_2$ is selected from specific electron withdrawing groups, the coupler forms a cyan dye, and the coupler can be used as a coupler having excellent color forming properties, color reproducibility, and heat and light fastness.

BRIEF DESCRIPTION OF THE ACCOMPANYING DRAWING

The sole figure of the drawing is a graph showing the absorption spectrum of an ethyl acetate solution of a cyan dye obtained on oxidative coupling of Coupler II-5) according to the present invention using N-ethyl-N-(β-methanesulfonamidoethyl)-3-methyl-aminoaniline as an aromatic primary amine color developing agent.

DETAILED DESCRIPTION OF THE INVENTION

The Hammett's substituent constant $\sigma p$ value used in the present invention is explained below.

The Hammett's rule is an empirical rule was proposed by L. P. Hammett in 1935 in order to quantitatively examine the effect of a substituent on a reaction of or equilibrium of a benzene derivative and it is well known at present.

The substituent constants obtained by the Hammett's rule include σp values and om values and these values are described in detail in many references, for example, J. A. Dean (Ed.) *Lange's Handbook of Chemistry,* 12th Edition (McGraw Hill, 1979) and *Kagaku no Ryoiki Zokan,* Vol. 122, pages 96 to 103 (Nankodo, 1979).

In the present invention, each substituent is defined by the substituent constant σp value. It should be noted that the substituents are not limited to those with known values, but include substituents with Hammett's substituent constant σp values within the above described range determined based on Hammett's rule, even if the values of the substituents are not known but must be measured.

The substituents represented by $R_1$, $R_2$, $R_3$ and X in the general formulae (I) and (II) are described in detail below.

$R_1$, $R_2$ and $R_3$ each represents a hydrogen atom or a substituent. Examples of substituents include a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, an alkyl- or aryl-sulfonamido group, a carbamoyl group, a sulfamoyl group, an alkyl- or aryl-sulfonyl group, an alkyl- or aryl-sulfonyloxy group, an alkoxycarbonyl group, a heterocyclic oxy group, an alkyl- or aryl-azo group, an alkyl- or aryl-oxysulfonyl group, an acyloxy group, a carbamoyloxy group, a silyloxy group, an aryloxycarbonylamino group, an imido group, a selenocyanate group, a heterocyclic thio group, an alkyl- or aryl-sulfinyl group, a phosphinyl group, a phosphonyl group, a phosphono group, an aryloxycarbonyl group, an acyl group, an acylthio group, an azolyl group, an isocyanate, a thiocyanate group and an alkyl- or aryl-thiocarbonyl group. These groups may be further substituted with at least one of these substituents. $R_1$ and $R_2$ may be bonded to form a ring.

In the present invention, an acyl moiety includes an aliphatic- and aromatic-acyl moiety; a heterocyclic moiety in the substituents (unless otherwise defined) includes a 5- to 7-membered heterocyclic moiety containing at least one of N, O and S atoms, generally the numbers of N, O and S atoms in the ring is 1 to 4, 0 to 1 and 0 to 1, respectively, and the heterocyclic group may be condensed with a phenyl or naphthyl group; an alkyl group is specifically defined as a substituted or unsubstituted, saturated or unsaturated, aliphatic or alicyclic hydrocarbon group; and an aryl group includes a phenyl and naphthyl group.

More specifically, $R_1$, $R_2$ and $R_3$ each represents a hydrogen atom, a halogen atom (e.g., fluorine, chlorine, or bromine), an alkyl group (for example, a straight chain or branched chain alkyl, aralkyl, alkenyl, alkynyl, cycloalkyl, or cycloalkenyl group having from 1 to 32 carbon atoms including, e.g., methyl, ethyl, propyl, isopropyl, tert-butyl, tridecyl, 2-methanesulfonylethyl, 3-(3-pentadecylphenoxy)propyl, 3-[4-{2-[4-(4-hydroxyphenylsulfonyl)phenoxy]dodecanamido}phenyl]propyl, 2-ethoxytridecyl, trifluoromethyl, heptafluoropropyl, cyclopentyl, or 3-(2,4-di-tert-amylphenoxy)propyl), an aryl group (e.g., phenyl, 4-tert-butylphenyl, 2,4-di-tert-amylphenyl, 4-tetradecanamidophenyl, 2,4-dinitrophenyl, 2,4,6-trichlorophenyl, or pentachlorophenyl), a heterocyclic group (e.g., 2-furyl, 2-thienyl, 2-pyrimidinyl, 2-benzoxazolyl, 1-phenyl-2-benzimidazolyl, 2-benzothiazolyl, 5-chloro-1-tetrazolyl, or 1-pyrrolyl), a cyano group, a hydroxy group, a nitro group, a carboxy group, a sulfo group, an amino group, an alkoxy group (e.g., methoxy, ethoxy, 2-methoxyethoxy, 2-dodecyloxyethoxy, 2-methanesulfonylethoxy, or trifluoromethoxy), an aryloxy group (for example, phenoxy, 2-methylphenoxy, 4-tert-butylphenoxy, 3-nitrophenoxy, 3-tert-butyloxycarbamoylphenoxy, or pentafluorophenoxy), an acylamino group (e.g., acetamido, benzamido, tetradecanamido, 2-(2,4-di-tert-amylphenoxy)butanamido, 4-(3-tert-butyl-4-hydroxyphenoxy)-butanamido, or 2-[4-(4-hydroxyphenylsulfonyl) phenoxy]-decanamido), an alkylamino group (e.g., methylamino, butylamino, dodecylamino, diethylamino, methylbutylamino, or N,N-di-(trifluoromethyl-)amino), an anilino group (e.g., phenylamino, 2-chloroanilino, 2-chloro-5-tetradecanaminoanilino, 2-chloro-5-dodecyloxycarbonylanilino, N-acetylanilino, or 2-chloro-5-[2-(3-tert-butyl-4-hydroxyphenoxy)-dodecanamido]anilino), a ureido group (e.g., phenylureido, methylureido, or N,N-dibutylureido), a sulfamoylamino group (e.g , N,N-dipropylsulfamoylamino, or N-methyl-N-decylsulfamoylamino), an alkylthio group (for example, methylthio, octylthio, tetradecylthio, 2-phenoxyethylthio, 3-phenoxypropylthio, 3-(4-tert-butylphenoxy)propylthio, difluoromethylthio, or 1,1,2,2-tetrafluoroethylthio), an arylthio group (e.g., phenylthio, 2-butoxy-5-tert-octylphenylthio, 3-pentadecylphenylthio, 2-carboxyphenylthio, or 4-tetradecanamidophenylthio), an alkoxycarbonylamino group (e.g., methoxycarbonylamino, or tetradecyloxycarbonylamino), an alkyl- or aryl-sulfonamido group (e.g., methanesulfonamido, hexadecanesulfonamido, benzenesulfonamido, p-toluenesulfonamido, octadecanesulfonamido, or 2-methoxy-5-tert-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, or N-[3-(2,4-di-tert-amylphenoxy)propyl]carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, or N,N-diethylsulfamoyl), an alkyl- or aryl-sulfonyl group (e.g., methanesulfonyl, octanesulfonyl, benzenesulfonyl, or toluenesulfonyl), an alkyl- or aryl-sulfonyloxy group (e.g., methanesulfonyloxy, or toluene-sulfonyloxy), an alkoxycarbonyl group (e.g., methoxycarbonyl, butoxycarbonyl, dodecyloxycarbonyl, or octadecyloxycarbonyl), a heterocyclic oxy group (e.g., 1-phenyltetrazolyl-5-oxy, or 2-tetrahydropyranyloxy), an alkyl- or aryl-azo group (e.g., phenylazo, 4-methoxyphenylazo, 4-pivaloylaminophenylazo, or 2-hydroxy-4-propanoylphenylazo), an acyloxy group (e.g., acetoxy), a carbamoyloxy group (e.g., N-methylcarbamoyloxy, or N-phenylcarbamoyloxy), a silyloxy group (e.g., trimethylsilyloxy, or dibutylmethylsilyloxy), an aryloxycarbonylamino group (e.g., phenoxycarbonylamino), an imido group (e.g., N-succinimido, N-phthalimido, or 3-octadecenylsuccinimido), a selenocyanate group, a heterocyclic thio group (e.g., 2-benzothiazolylthio, 2,4-di-phenoxy-1,3,5-triazolyl-6-thio, or 2-pyridylthio), an alkyl- or aryl-sulfinyl group (e.g., dodecanesulfinyl, 3-pentadecylphenylsulfinyl, or 3-phenoxypropylsulfinyl), a phosphinyl group (e.g., diphenylphosphinyl), a phosphonyl group (e.g., phenoxyphosphonyl, octyloxyphosphonyl, or phenylphosphonyl), a phosphono group (e.g., dimethylphosphono, or diphenylphosphono), an aryloxycarbonyl group (e.g., phenoxycarbonyl), an acyl group (e.g., acetyl, 3-phenylpropanoyl, benzoyl, or 4-dodecyloxybenzoyl), an acylthio group (e.g., acetylthio, or benzoylthio), an azolyl group (e.g., imidazolyl, pyrazolyl, 3-chloropyrazol-1-yl, or triazolyl), a thiocyanate group, or an alkyl- or aryl-thiocarbonyl group (e.g., methylthiocarbonyl, or phenylthiocarbonyl).

In the general formula (I) or (II) according to the present invention, at least one of $R_1$ and $R_2$ is an electron withdrawing substituent having a Hammett's substituent constant $\sigma p$ value of 0.15 or more.

Suitable examples of electron withdrawing substituents having a $\sigma p$ value of 0.15 or more include an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, an alkylthio group, an arylthio group, an alkyl- or aryl-oxysulfonyl group, an acylthio group, a sulfamoyl group, an isocyanate group, a thiocyanate group, an alkyl- or aryl-thiocarbonyl group, a halogenated alkyl group, a halogenated alkoxy group, a halogenated aryloxy group, a halogenated alkylamino group, a halogenated alkylthio group, a substituted aryl group, a heterocyclic group, a chlorine atom, a bromine atom, an alkyl- or aryl-azo group and a selenocyanate group.

Of these substituents, those capable of being substituted may further have at least one substituent bonded through a carbon atom, an oxygen atom, a nitrogen atom or a sulfur atom included in the substituents described for the substituents represented by $R_3$, or a halogen atom.

In greater detail, examples of electron withdrawing substituents having a $\sigma p$ value of 0.15 or more include an acyl group (e.g., acetyl, 3-phenylpropanoyl, benzoyl, or 4-dodecyloxybenzoyl), an acyloxy group (e.g., acetoxy), a carbamoyl group (e.g., N-ethylcarbamoyl, N,N-dibutylcarbamoyl, N-(2-dodecyloxyethyl)carbamoyl, N-methyl-N-dodecylcarbamoyl, or N-[3-(2,4-di-tert-amylphenoxy)propyl] carbamoyl), an alkoxycarbonyl group (e.g., methoxycarbonyl, butyloxycarbonyl, dodecyloxycarbonyl, or octadecyloxycarbonyl), an aryloxycarbonyl group (e.g., phenoxycarbonyl), a cyano group, a nitro group, a dialkylphosphono group (e.g., dimethylphosphono), a diarylphosphono group (e,g., diphenylphosphono), a diarylphosphinyl group (e.g., diphenyl-phosphinyl), an alkylsulfinyl group (e.g., 3-phenoxypropylsulfinyl), an arylsulfinyl group (e.g., 3-pentadecylphenylsulfinyl), an alkylsulfonyl group (e.g., methanesulfonyl, or octanesulfonyl), an arylsulfonyl group (e.g., benzenesulfonyl, or toluenesulfonyl), an alkylthio group (e.g., methylthio, octylthio, tetradecylthio, 2-phenoxyethylthio, 3-phenoxypropylthio, or 3-(4-tert-butylphenoxy)propylthio), an arylthio group (e.g., phenylthio, 2-butoxy-5-tert-octylphenylthio, 3-pentadecylphenylthio, 2-carboxyphenylthio, or 4-tetradecanamidophenylthio), an alkyl- or aryl-oxysulfonyl group (e.g., methanesulfonyloxy, or toluenesulfonyloxy), an acylthio group (e.g., acetylthio, or benzoylthio), a sulfamoyl group (e.g., N-ethylsulfamoyl, N,N-dipropylsulfamoyl, N-(2-dodecyloxyethyl)sulfamoyl, N-ethyl-N-dodecylsulfamoyl, or N,N-diethylsulfamoyl), an isocyanate group, a thiocyanate group, a thiocarbonyl group (e.g., methylthiocarbonyl, or phenylthiocarbonyl), a halogenated alkyl group (e.g., trifluoromethyl, or heptafluoropropyl), a halogenated alkoxy group (e.g., trifluoromethoxy), a halogenated aryloxy group (e.g., pentafluorophenoxy), a halogenated alkylamino group (e.g., N,N-di-(trifluoromethyl)amino), a halogenated alkylthio group (e.g., difluoromethylthio, or 1,1,2,2-tetrafluoroethylthio), an aryl group substituted with other electron withdrawing group having the $\sigma p$ value of not less than 0.15 (e.g., 2,4-dinitrophenyl, 2,4,6-trichlorophenyl, or pentachlorophenyl), a heterocyclic group (e.g., 2-benzoxazolyl, 2-benzothiazolyl, 1-phenyl-2-benzimidazolyl, 5-chloro-1-tetrazolyl, or 1-pyrrolyl), a chlorine atom, or a bromine atom, an alkyl- or aryl-azo group and a selenocyanate group.

In the general formula (I) or (II) according to the present invention, at least one of $R_1$ and $R_2$ is preferably an electron withdrawing substituent having a op value of 0.20 or more, more preferably an electron withdrawing substituent having a $\sigma p$ value of 0.30 or more, and further more preferably an electron withdrawing substituent having a $\sigma p$ value of 0.60 or more. The upper limit of the $\sigma p$ value is preferably about 1.0.

Of the above described electron withdrawing substituents, those having a $\sigma p$ value of 0.20 or more include an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, an alkyloxysulfonyl group, an aryloxysulfonyl group, an acylthio group, a sulfamoyl group, a thiocyanate group, an alkyl- or arylthiocarbonyl group, a halogenated alkyl group, a halogenated alkoxy group, a halogenated aryloxy group, a halogenated alkylamino group, a halogenated alkylthio group, an aryl group substituted with other electron withdrawing group having the $\sigma p$ value of not less than 0.20, and a heterocyclic group, a chlorine atom, a bromine atom, an alkyl- or aryl-azo group and a selenocyanate group.

Of the above described electron withdrawing substituents, those having a $\sigma p$ value of 0.30 or more include an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkoxy group, a halogenated aryloxy group, a halogenated alkylthio group, an aryl group substituted with two or more other electron withdrawing substituents each having a $\sigma p$ value of 0.15 or more and a heterocyclic group.

Of the above described electron withdrawing substituents, those having a $\sigma p$ value of 0.60 or more are a cyano group, a nitro group and an alkylsulfonyl group.

In the general formula (I) or (II) according to the present invention, at least one of $R_1$ and $R_2$ is an electron withdrawing substituent having a $\sigma p$ value of 0.15 or more, as described above The other of $R_1$ and $R_2$ is preferably an electron withdrawing substituent, more preferably an electron withdrawing substituent having a $\sigma p$ value of 0.15 or more, and further more preferably an electron withdrawing substituent having a $\sigma p$ value of 0.20 or more.

Further, the sum of the $\sigma p$ values of $R_1$ and $R_2$ is preferably 0.60 or more, more preferably 0.65 or more, and further more preferably 0.70 or more. The upper limit of the sum of the $\sigma p$ values is preferably about 1.8.

The $\sigma p$ value of some groups are shown below: CN—: 0.66 $NO_2$—: 0.78 $CH_3CO$—: 0.50 $CH_3OCO$: 0.45 $CH_3SO_2$—: 0.72 $CF_3$: 0.54 $NH_2CO$—: 0.36

Examples of combinations of the groups of which the sum of the $\sigma p$ values are 0.60 or more are CN— and $CH_3CO$— (the sum is 1.16), CN— and $CH_3OCO$— (the sum is 1.11), and CN— and $NH_2CO$— (the sume is 1.02).

Preferred substituents for $R_3$ include an alkyl group, an aryl group, a heterocyclic group, a cyano group, a nitro group, an acylamino group, an anilino group, a ureido group, a sulfamoylamino group, an alkylthio group, an arylthio group, an alkoxycarbonylamino group, a sulfonamido group, a carbamoyl group, a sulfamoyl group, an alkyl- or aryl-sulfonyl group, an alkoxycarbonyl group, a heterocyclic oxy group, an acyloxy group, a carbamoyloxy group, an aryloxycarbonylamino group, an imido group, a heterocyclic thio group, an alkyl- or aryl-sulfinyl group, a phosphonyl group, an aryloxycarbonyl group, an acyl group, and an azolyl group.

More preferably, $R_3$ represents an alkyl group or an aryl group.

X represents a hydrogen atom, or a substituent capable of being released upon coupling with an oxidation product of a color developing agent. Examples of substituents capable of being released include a halogen atom, an alkoxy group, an aryloxy group, an acyloxy group, an alkyl- or aryl-sulfonyloxy group, an acylamino group, an alkyl- or aryl-sulfonamido group, an alkoxycarbonyloxy group, an aryloxycarbonyloxy group, an alkyl-, aryl- or heterocyclic-thio group, a carbamoylamino group, a 5-membered or 6-membered nitrogen-containing heterocyclic group, an imido group, or an arylazo group. These groups may be further substituted with the substituents as described for $R_3$.

More specifically, X includes a halogen atom (e.g., fluorine, chlorine, or bromine), an alkoxy group (e.g., ethoxy, dodecyloxy, methoxyethylcarbamoylmethoxy, carboxypropyloxy, methylsulfonylethoxy, or ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 3-acetylaminophenoxy, or 2-carboxyphenoxy), an acyloxy group (e.g., acetoxy, tetradecanoyloxy, or benzoyloxy), an alkyl- or aryl-sulfonyloxy group (e.g., methanesulfonyloxy, or toluenesulfonyloxy), an acylamino group (e.g., dichloroacetylamino, or heptafluorobutyrylamino), an alkyl- or arylsulfonamido group (e.g., methanesulfonamino, trifluoromethanesulfonamino, or p-toluenesulfonylamino), an alkoxycarbonyloxy group (e.g., ethoxycarbonyloxy, or benzyloxycarbonyloxy), an aryloxycarbonyloxy group (e.g., phenoxycarbonyloxy), an alkyl-, aryl- or heterocyclic-thio group (e.g., dodecylthio, 1-carboxydodecylthio, phenylthio, 2-butoxy-5-tert-octylphenylthio, or tetrazolylthio), a carbamoylamino group (e.g., N-methylcarbamoylamino, or N-phenylcarbamoylamino), a 5-membered or 6-membered nitrogen-containing heterocyclic group preferably containing 1 to 4 N atoms, and furthermore O or S may also be contained (e.g., imidazolyl, pyrazolyl, triazolyl, tetrazolyl, or 1,2-dihydro-2-oxo-1-pyridyl), an imido group (e.g., succinimido, or hydantoinyl), an arylazo group (e.g., phenylazo, or 4-methoxyphenylazo).

X further represents a releasable group bonded through a carbon atom. In such a case, the coupler may form a bis type coupler obtained by condensation of a 4-equivalent coupler with an aldehyde or ketone. Moreover, X may contain a photographically useful group, for example, a group forming a development inhibitor or development accelerator on release.

Preferred examples of X include a halogen atom, an alkoxy group, an aryloxy group, an alkyl- or aryl-thio group, and a 5-membered or 6-membered nitrogen-containing heterocyclic group bonded to the coupling active position through a nitrogen atom.

$R_1$, $R_2$, $R_3$ or X may represent a divalent group and $R_1$, $R_2$ or $R_3$ may further represent a single bond to form a bis-compound or a polymer. In cases wherein the coupler is a bis-compound $R_1$, $R_2$ and $R_3$ each represents a substituted or unsubstituted alkylene group (for example, a methylene group, an ethylene group, a 1,10-decylene group, —$CH_2CH_2$—O—$CH_2CH_2$—, etc.); a substituted or unsubstituted phenylene group (for example, a 1,4-phenylene group, a 1,3-phenylene group,

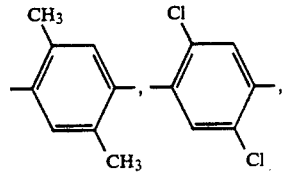

etc.); a group of the formula: —NHCO—$R_4$—CONH— (wherein $R_4$ represents a substituted or unsubstituted phenylene group) including, for example, —NH-$COCH_2CH_2CONH$—,

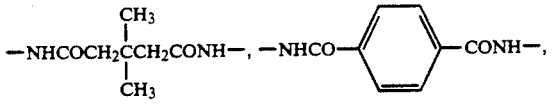

etc.; or a group of the formula: —S—$R_4$—S— (wherein $R_4$ is the same meaning as defined above) including for example, —$SCH_2CH_2S$—,

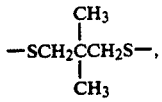

etc.; and X represents a divalent group appropriately formed from the monovalent group for X described above.

In the cases wherein the coupler is a polymer coupler, the coupler may be that which is derived from a vinyl monomer having a coupler moiety derived from the above-described coupler (other than the bis-compound or the polymer) represented by formula (i) or (II) and having a vinyl group through a linking group or a single bond.

The examples of the linking group represented by $R_1$, $R_2$, $R_3$ or X include an alkylene group including a substituted alkylene group (for example, a methylene group, an ethylene group, a 1,10-decylene group, —$CH_2CH_2OCH_2CH_2$—, etc.); a phenylene group including a substituted phenylene group (for example, a 1,4-phenylene group, a 1,3-phenylene group,

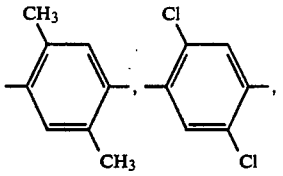

etc.); —NHCO—; —CONH—; —O—; —OCO—; an aralkylene group (for example,

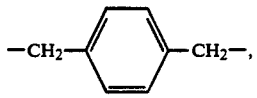

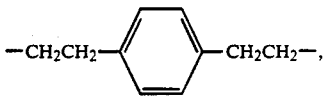

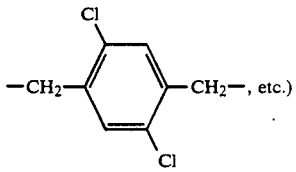

or a combination thereof.

Specific examples of preferred linking groups are set forth below.

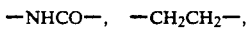

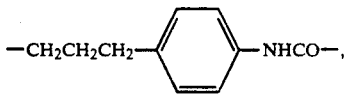

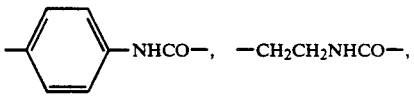

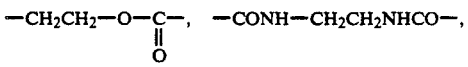

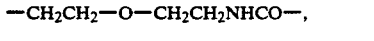

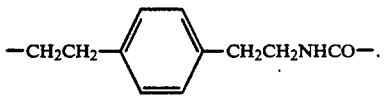

The vinyl group in the vinyl monomer may have a substituent at the carbon atom at which the linking group is bonded. Preferred examples of such a substituent include a halogen atom or a lower alkyl group having from 1 to 4 carbon atoms (for example, a methyl group, an ethyl group, etc.).

The vinyl monomer may be used together with a non-color-forming ethylenic monomer which does not couple with the oxidation product of an aromatic primary amine developing agent to form a copolymer.

Examples of the non-color forming monomer which does not couple with the oxidation product of an aromatic primary amine developing agent include an acrylic acid (for example, acrylic acid α-chloroacrylic acid, an α-alkylacrylic acid such as methacrylic acid, etc.), an ester or an amide derived from an acrylic acid (for example, acrylamide, n-butylacrylamide, t-butylacrylamide, diacetoneacrylamide, methacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate, β-hydroxyethyl methacrylate, methylene bisacrylamide, etc.), a vinyl ester (for example, vinyl acetate, vinyl propionate, vinyl laurate, etc.), acrylonitrile, methacrylonitrile, an aromatic vinyl compound (for example, styrene and a derivative thereof, for example, vinyl toluene, divinyl benezene, vinyl acetophenone, sulfo styrene etc.), itaconic acid, citraconic acid, crotonic acid, vinylidene chloride, a vinyl alkyl ether (for example, vinyl ethyl ether, etc.), maleic acid, maleic anhydride, an ester of maleic acid, N-vinyl-2-pyrrolidone, N-vinyl pyridine, 2- or 4-vinyl pyridine, etc. Two or more non-color-forming ethylenically unsaturated monomers described above can be used together. For example, a combination of n-butyl acrylate and methyl acrylate, styrene and methacrylic acid, methacrylic acid and acrylamide, methyl methacrylate and diacetoneacrylamide, etc., can be employed.

The non-color-forming ethylenically unsaturated monomer which is used to copolymerize with a solid water-insoluble monomer coupler can be selected so that the copolymer to be formed possesses good physical properties and/or chemical properties, for example, solubility, compatibility with a binder such as gelatin in a photographic colloid composition, flexibility, heat stability, etc. as is well known in the field of polymer color couplers.

Polymer couplers which can be used in the present invention may be water-soluble couplers or water-insoluble couplers. Particularly, polymer couplers in the form of a latex are preferably used.

The maximum wavelength of the dye obtained from the cyan coupler of the present invention is in the range of from 600 to 700 nm (preferably from 615 to 680 nm).

The couplers described in JP-A-62-278552 are only those having an alkyl group on the 6-position thereof, and they cannot form cyan color.

In order to incorporate the coupler according to the present invention into the light-sensitive material, it is preferred for the coupler to be a so-called coupler-in-emulsion type coupler. For such a purpose, at least one of $R_1$, $R_2$, $R_3$ and X preferably contains from 0 to 50 carbon atoms in total.

Specific examples of coupler of the formulas (I) and (II) according to the present invention are set forth below, but the present invention is not to be construed as being limited thereto.

I-1)
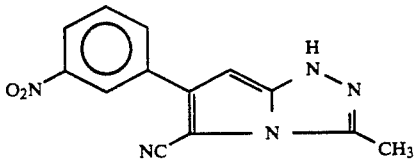
I-2)
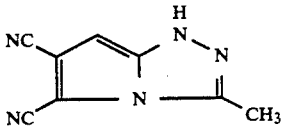
I-3)
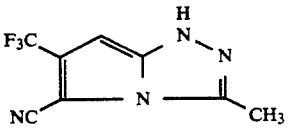
I-4)
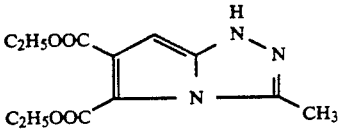
I-5
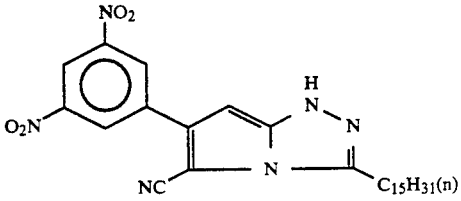
I-6)
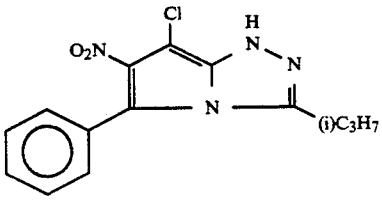
I-7)
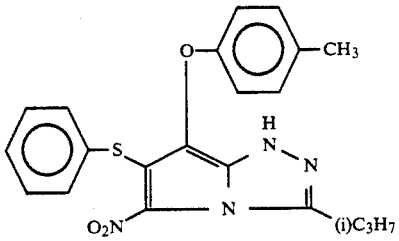
I-8)
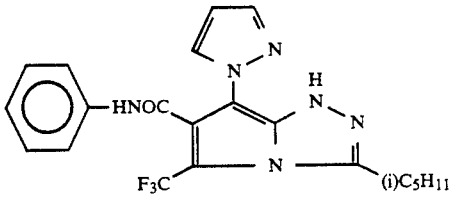
I-9)
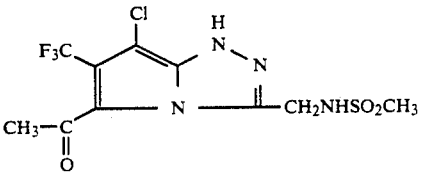
I-10)
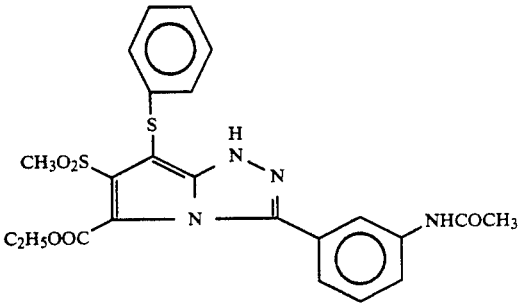
I-11)
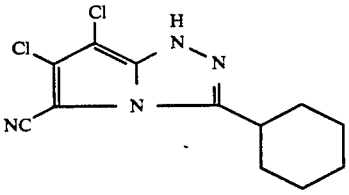
I-12)
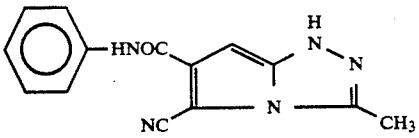
I-13)
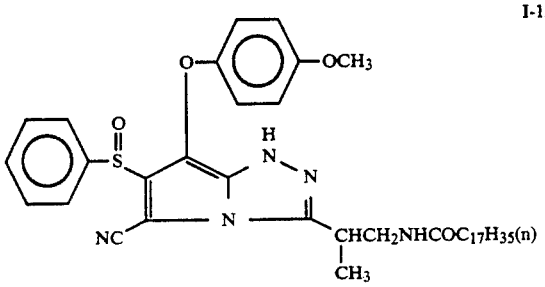
I-14)
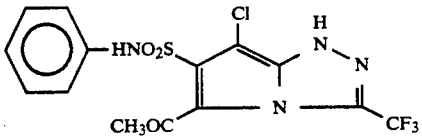

-continued
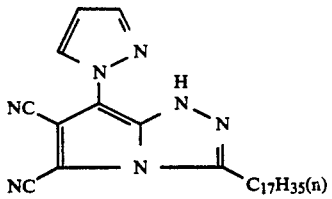
I-15)
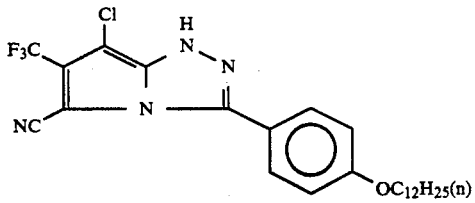
I-16)
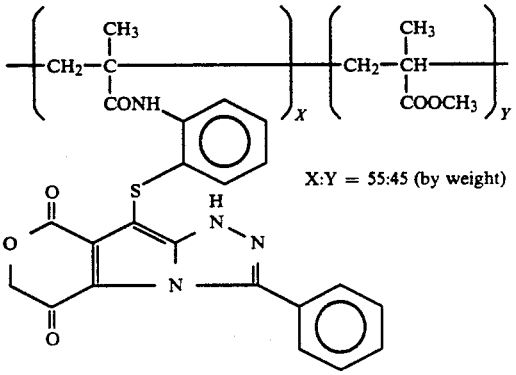
X:Y = 55:45 (by weight)
I-17)
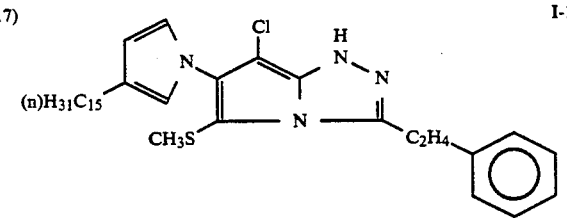
I-18)
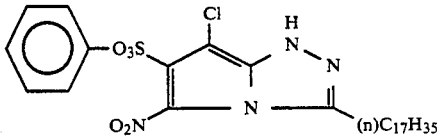
I-19)
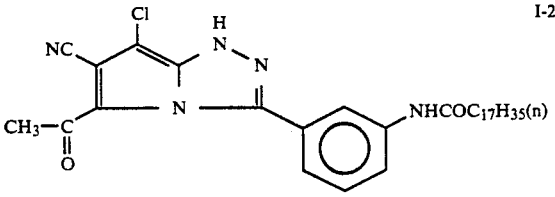
I-20)
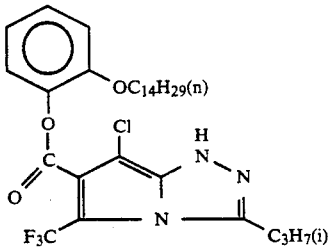
I-21)
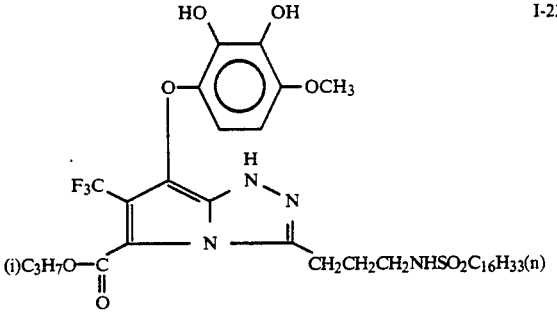
I-22)
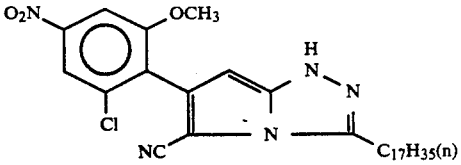
I-23)
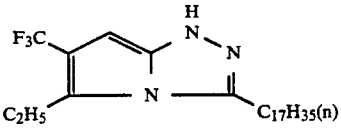
I-24)
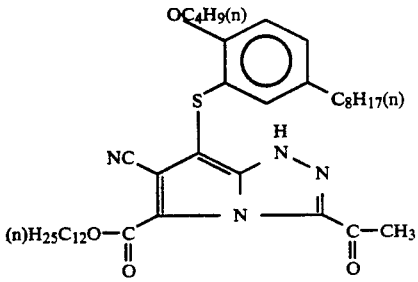
I-25)
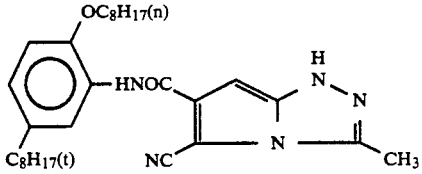
I-26)

-continued
I-27)
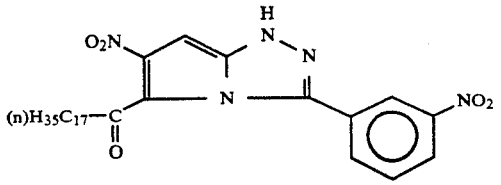
I-28)
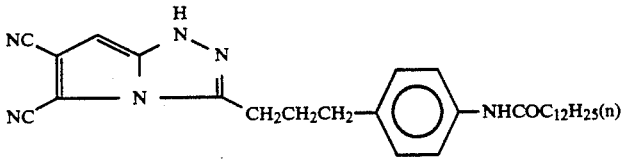
I-29)
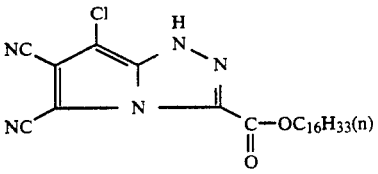
I-30)
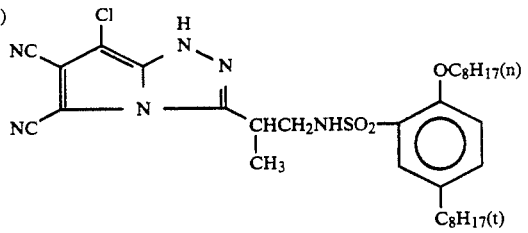
I-31)
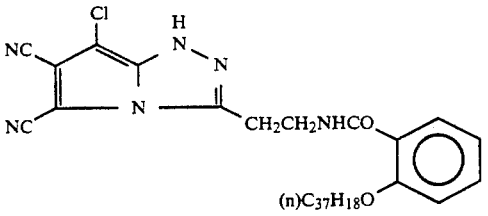
I-32)
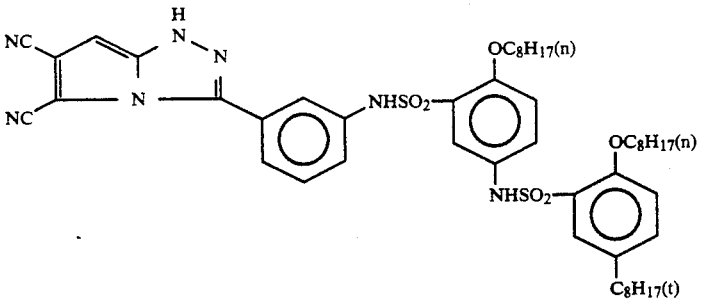
I-33)
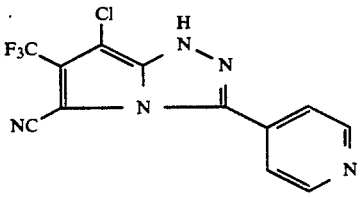

-continued
I-34)
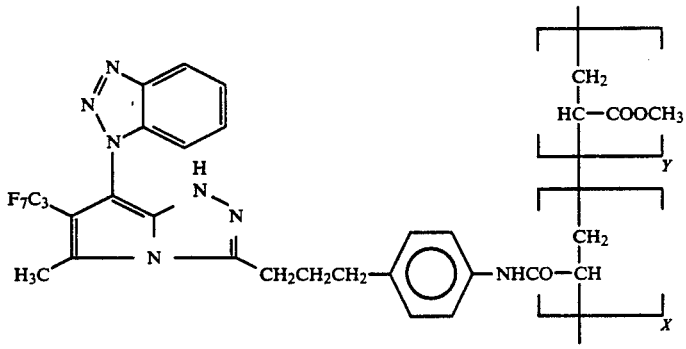
X:Y = 50:50 (by weight)
I-35)
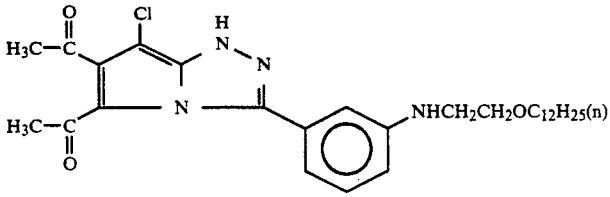
I-36)
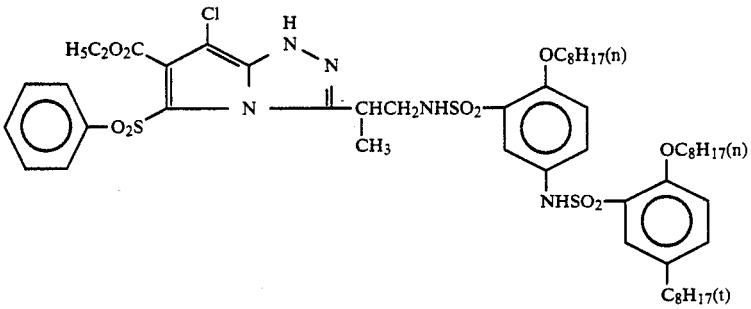
I-37)
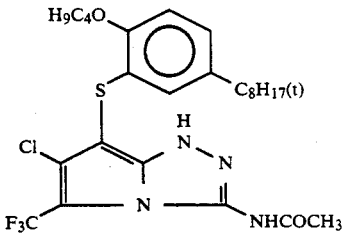
I-38)
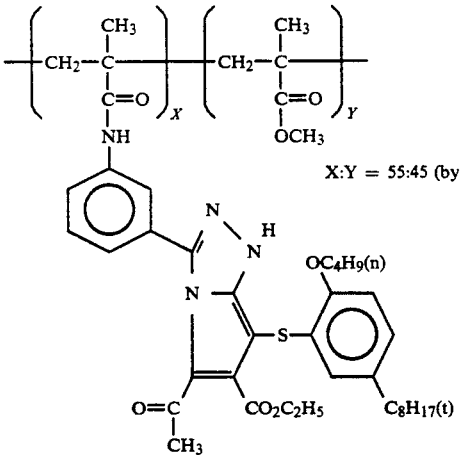
X:Y = 55:45 (by weight)
I-39)
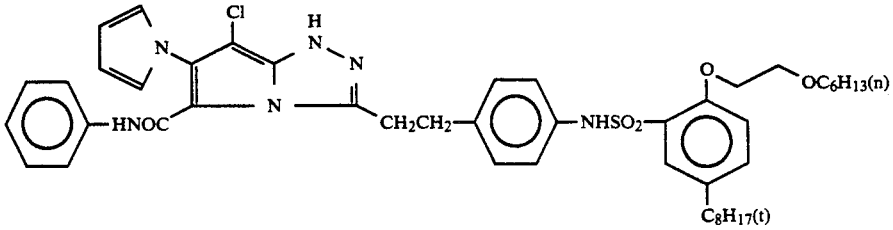

-continued
I-40)
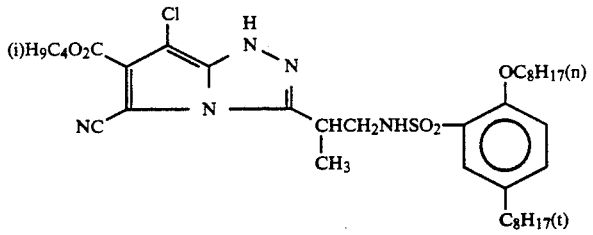
I-41)
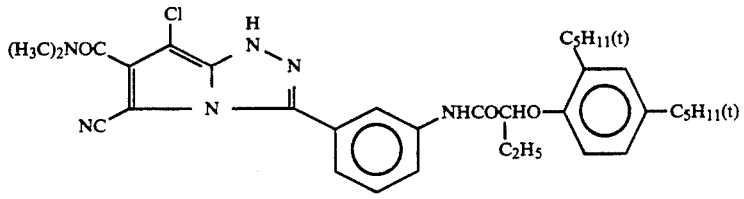
I-42)
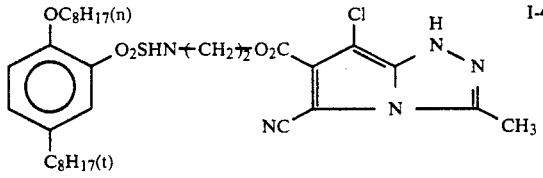
I-43)
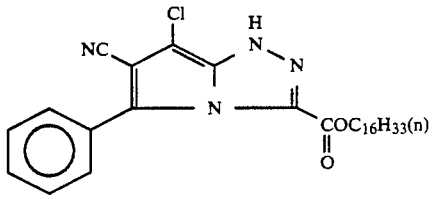
I-44)
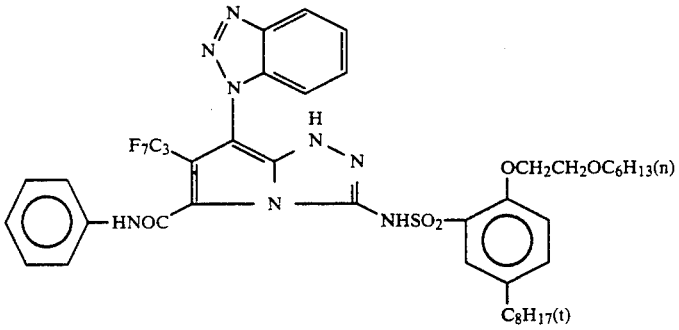
I-45)
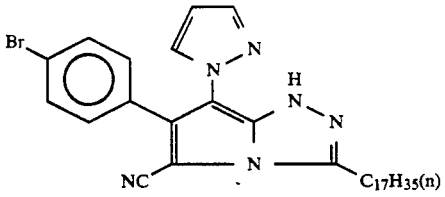
II-1)
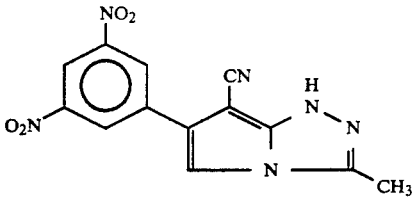
II-2)
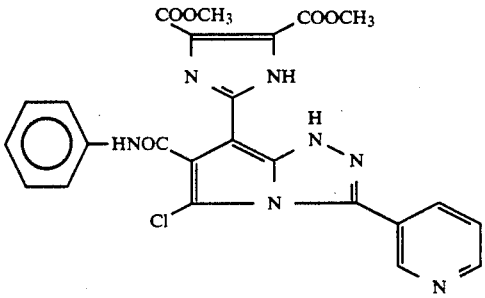
II-3)
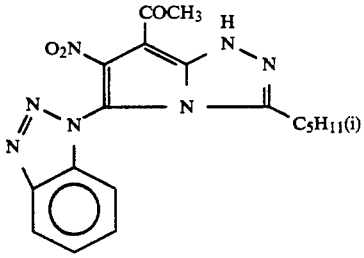

-continued
II-4)
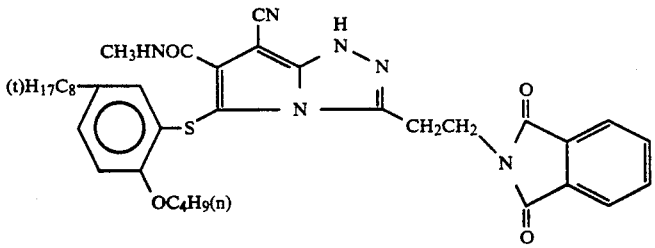
II-5)
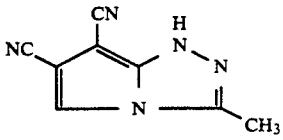
II-6)
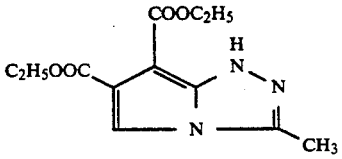
II-7)
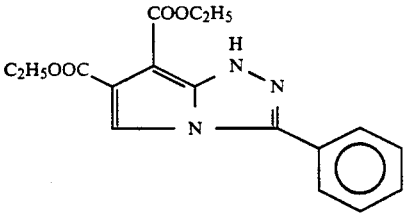
II-8)
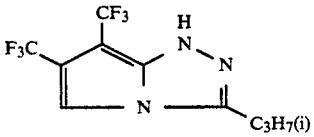
II-9)
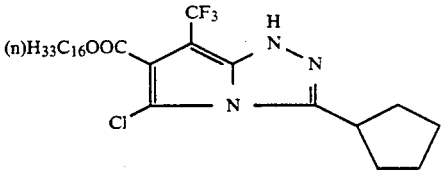
II-10)
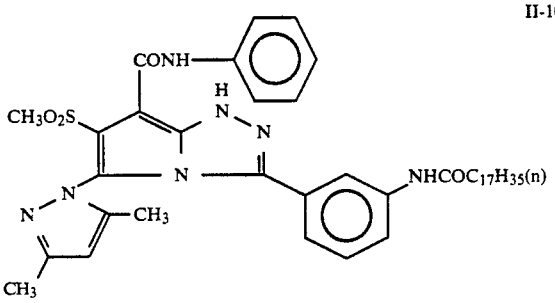
II-11)
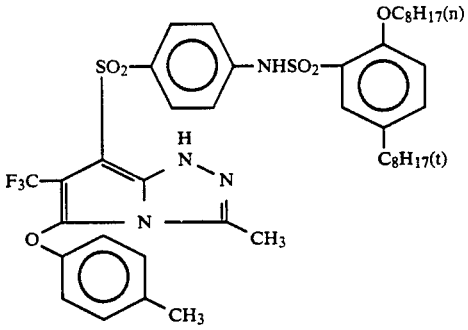
II-12)
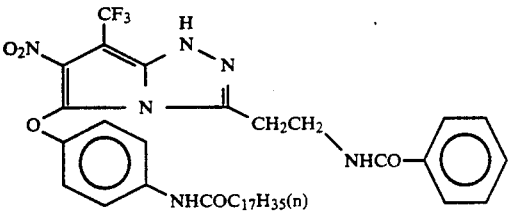
II-13)
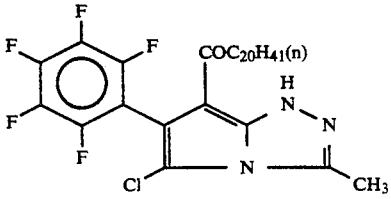

-continued
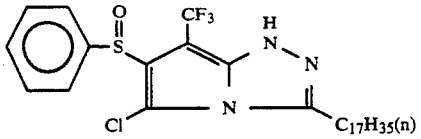
II-14)
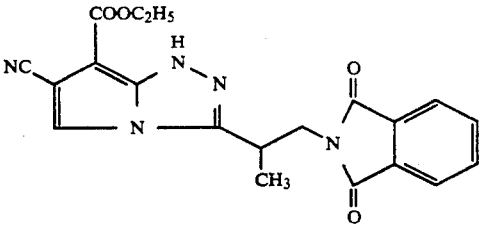
II-15)
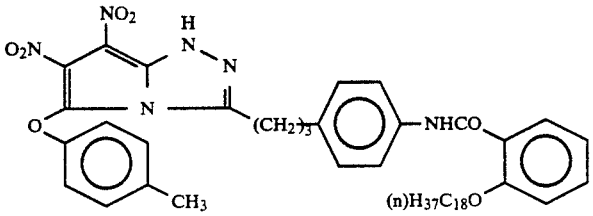
II-16)
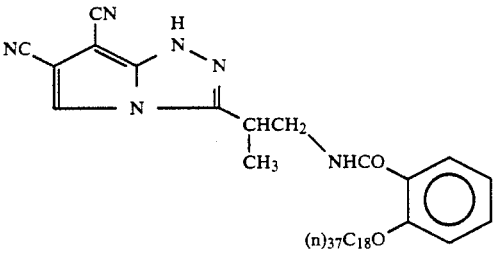
II-17)
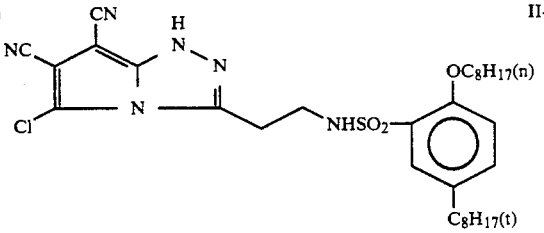
II-18)
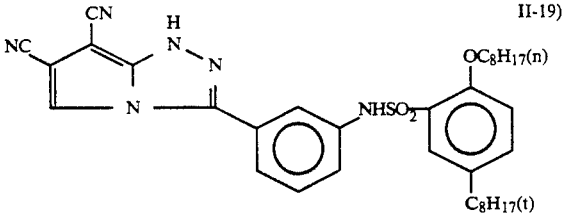
II-19)
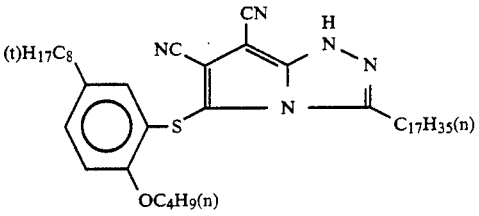
II-20)
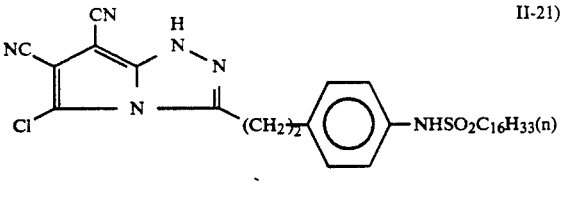
II-21)
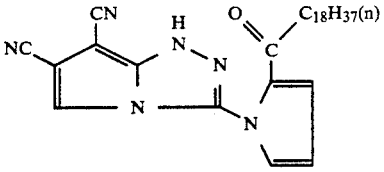
II-22)
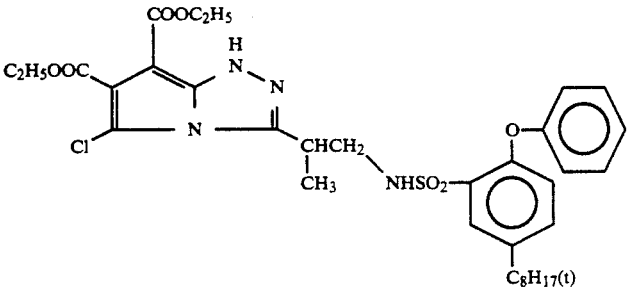
II-23)

-continued
II-24)
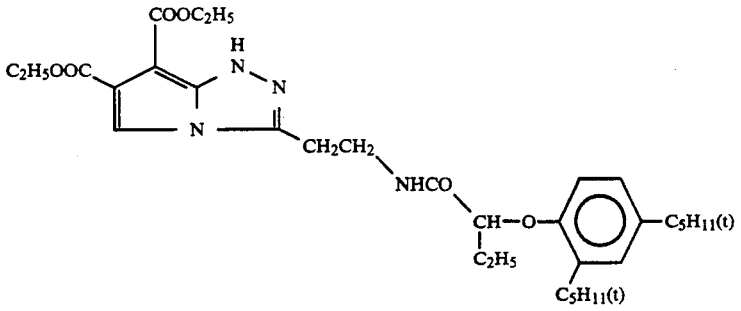
II-25)
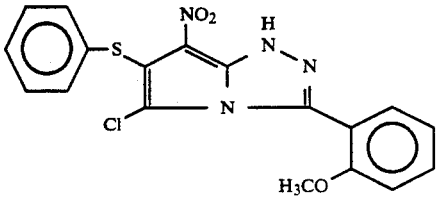
II-26)
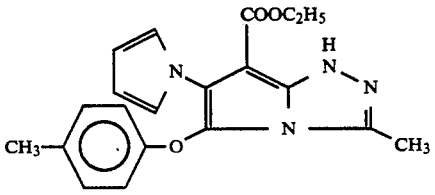
II-27)
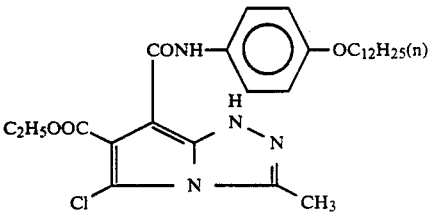
II-28)
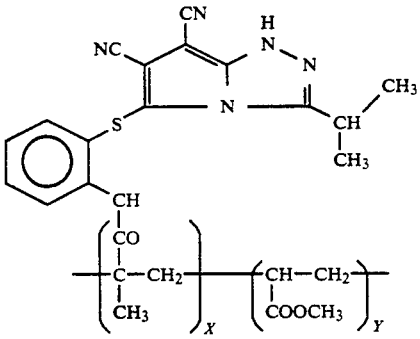
X:Y = 50:50 (by weight)
II-29)
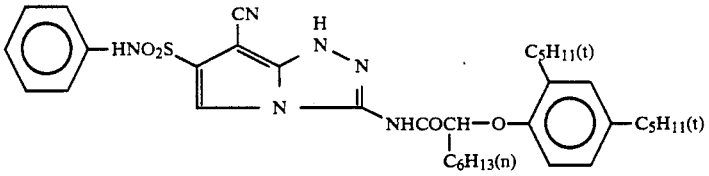
II-30)
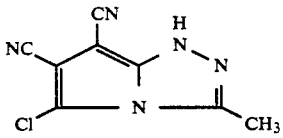
II-31)
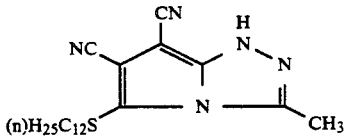
II-32)
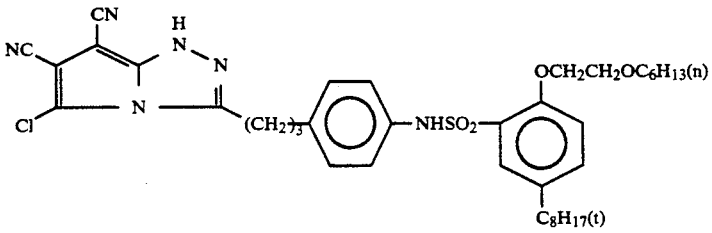

-continued
II-33)
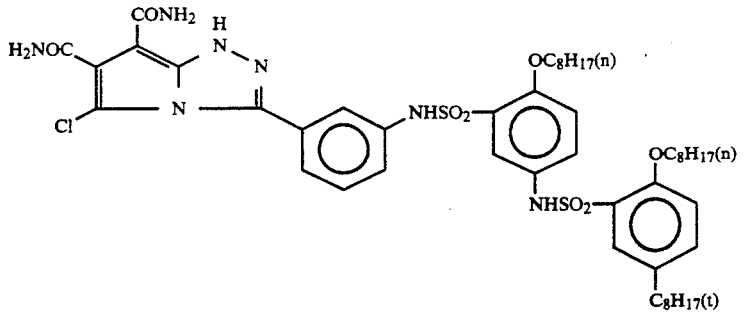
II-34)
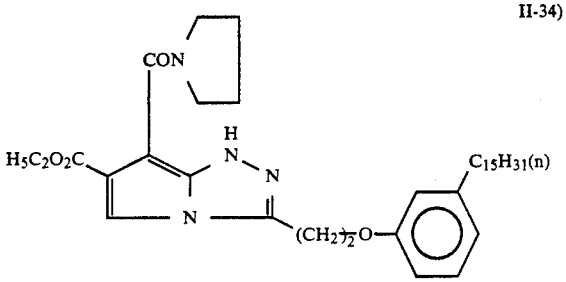
II-35)
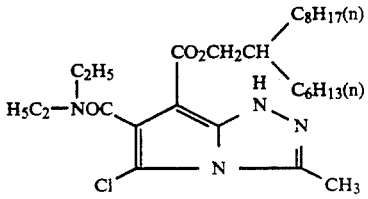
II-36)
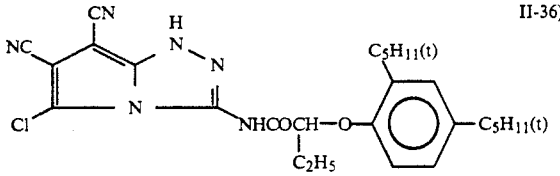
II-37)
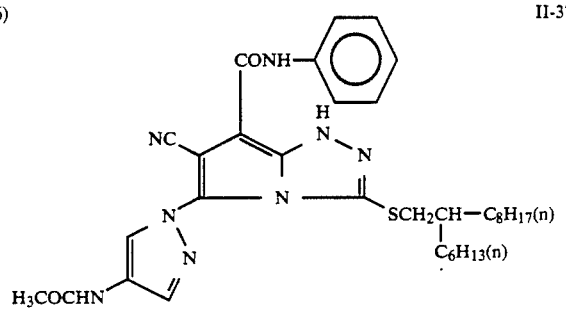
II-38)
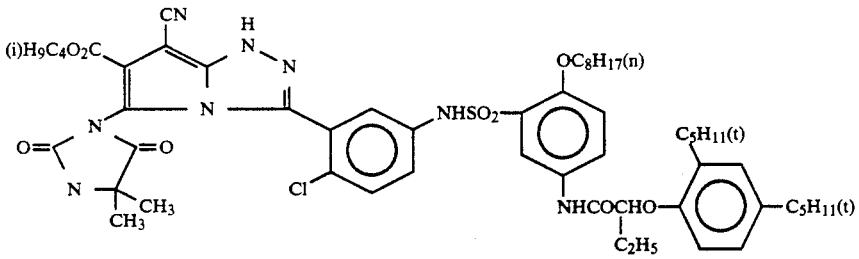
II-39)
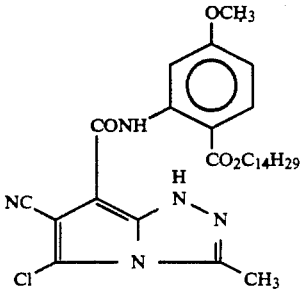

-continued
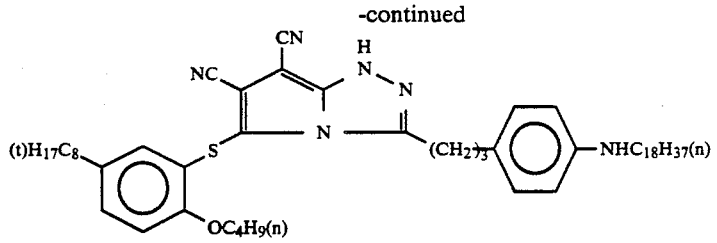
II-40)
Now a method for synthesis of the coupler according to the present invention is described below. A general method for synthesis can be illustrated by the following schemes (I), (II), (III), or (IV).
Scheme (I)
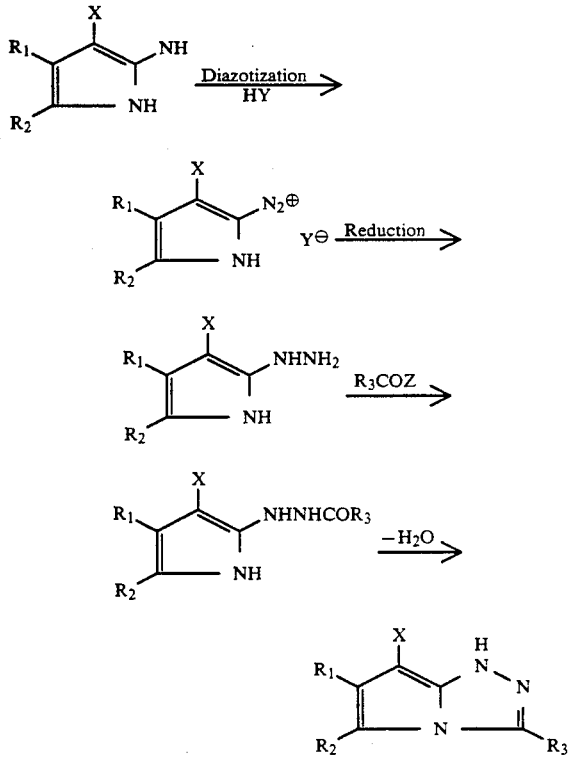
Scheme (II)
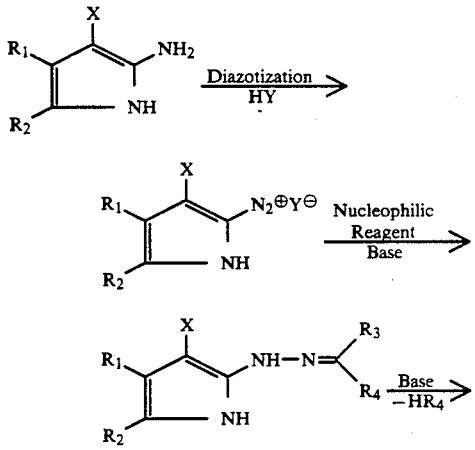
-continued
Scheme (II)
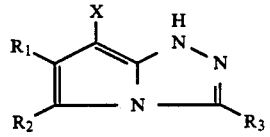
Scheme (III)
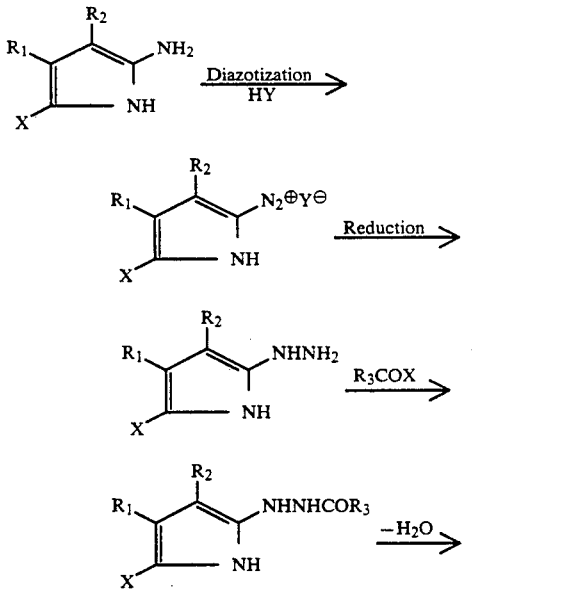
Scheme (IV)
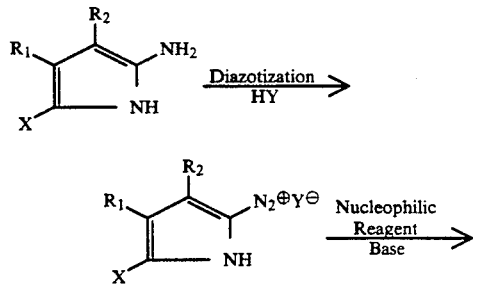

-continued

Scheme (IV)

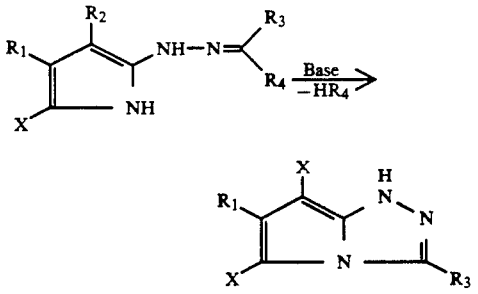

wherein $R_1$, $R_2$, $R_3$ and X each has the same meaning as defined above; $R_4$ represents a substituent capable of being released, for example, a halogen atom, a nitro group or a sulfinyl group; Y represents an acid anion; Z represents a substituent capable of being released, for example, a halogen atom or an acyloxy group; and a nucleophilic reagent is a compound which can easily effect coupling with a diazonium salt and has a substituent capable of being released such as $R_4$.

Synthesis examples of the cyan couplers according to the present invention are illustrated below.

SYNTHESIS EXAMPLE 1

Synthesis of Coupler I-2)

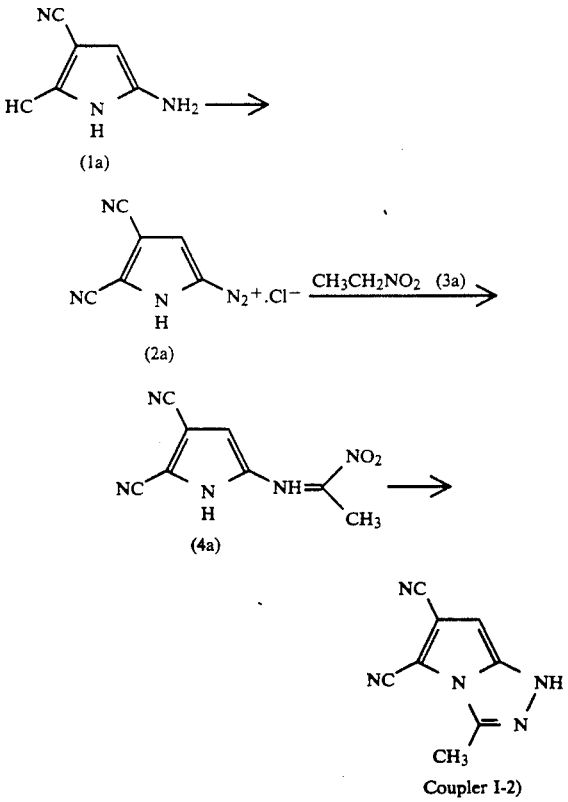

To 4.50 g (34.1 mmol) of 2-amino-4,5-dicyanopyrrole (Compound 1a) was added 28.5 ml of 36% hydrochloric acid, and a solution containing 2.58 g (37.5 mmol) of sodium nitrite in 5.2 ml of water was added dropwise thereto with stirring under cooling with ice over a period of 30 minutes, followed by stirring for 30 minutes. The resulting solution containing Compound 2a was designated Solution (1).

16.3 g (408.7 mmol) of sodium hydroxide was dissolved in a mixture of 100 ml of ethanol and 50 ml of water, and 4.89 ml (68.1 mmol) of nitroethane (Compound 3a) was added thereto with stirring under cooling with ice, followed by stirring for 30 minutes. To the resulting solution was added dropwise Solution (1) described above over a period of 35 minutes, and the mixture was stirred for 2 hours, color of which turned to dark orange. Then, the reaction solution was refluxed by heating with stirring for 2.5 hours, ethanol was distilled off under a reduced pressure, and the residue was extracted with ethyl acetate. The extract was washed with a saturated aqueous solution of sodium chloride and dried with sodium sulfate, and ethyl acetate was distilled off under a reduced pressure. The residue was purified by silica gel chromatography to obtain 1.45 g (25%) of Coupler I-2).

SYNTHESIS EXAMPLE 2

Synthesis of Coupler II-5)

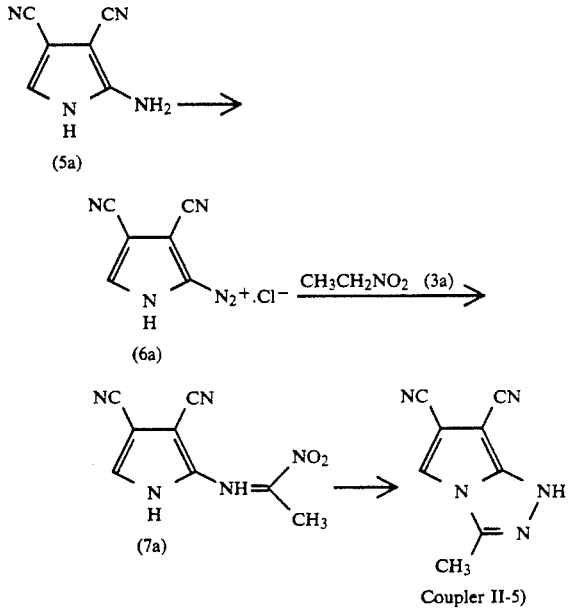

To 2.50 g (18.9 mmol) of 2-amino-3,4-dicyanopyrrole (Compound 5a) was added 15.8 mol of 36% hydrochloric acid, and a solution containing 1.44 g (20.8 mmol) of sodium nitrite in 2.9 ml of water was added dropwise thereto with stirring under cooling with ice over a period of 15 minutes, followed by stirring for 30 minutes. The resulting solution containing Compound 6a was designated Solution (2).

9.08 g (227.0 mmol) of sodium hydroxide was dissolved in a mixture of 50 ml of ethanol and 25 ml of water, and 2.7 ml (3.78 mmol) of nitroethane (Compound 3a) was added thereto with stirring under cooling with ice, followed by stirring for 30 minutes. To the resulting solution was added dropwise Solution (2) described above over a period of 20 minutes, and the mixture was stirred for 2 hours. Then, ethanol was distilled off under a reduced pressure, and to the residue was added 19 ml of 2N hydrochloric acid to adjust pH to about 5, water and sodium chloride were added thereto, and extracted twice with ethyl acetate. The extract was washed with a saturated aqueous solution of sodium chloride and dried with sodium sulfate, and ethyl acetate was distilled off under a reduced pressure. The residue was dissolved in 30 ml of ethanol, to the resulting solution was added 4.2 ml (20.8 mmol) of 28% sodium methylate, and the mixture was refluxed by heating for 2.5 hours. Then, ethanol was distilled off under a reduced pressure, an aqueous solution of sodium chloride was added thereto, and the mixture was extracted twice with ethyl acetate. The extract was dried with sodium sulfate, and ethyl acetate was distilled off under a reduced pressure. The residue was purified by silica gel chromatography to obtain 1.23 g (38%) of Coupler II-5).

Compound 5a used above was synthesized by nitration of 3,4-dicyanopyrrole prepared according to the method described in *Tetrahedron Letters*, page 5,337 (1972), followed by reduction of the nitro compound with iron.

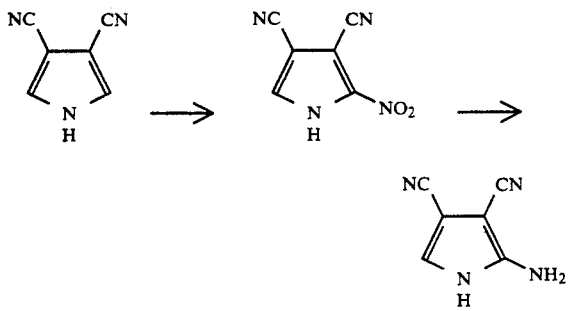

(5a)

SYNTHESIS EXAMPLE 3

Synthesis of Coupler II-7)

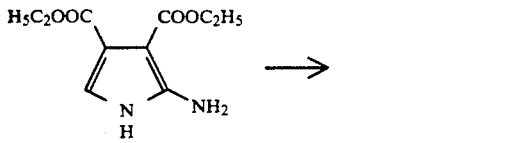

(8a)

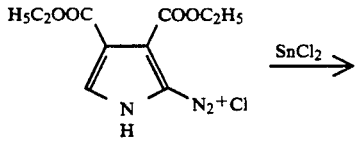

(9a)

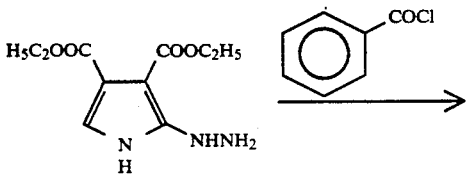

(10a)

-continued

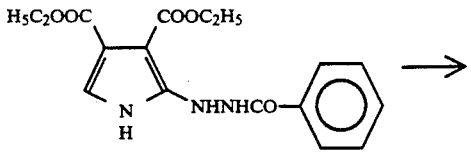

(11a)

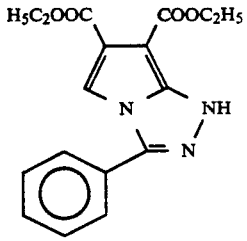

Coupler II-7)

To 8.00 g (35.2 mmol) of 2-amino-3,4-diethoxycarbonylpyrrole (Compound 8a) was added 23.6 ml of 36% hydrochloric acid, and a solution containing 2.68 g (38.9 mmol) of sodium nitrite in 5.4 ml of water was added dropwise thereto with stirring under cooling with ice over a period of 30 minutes, followed by stirring for 30 minutes. The resulting solution containing Compound 9a was added dropwise to a solution containing 14.8 g (77.7 mmol) of stannous chloride dissolved in 23.6 ml of 36% hydrochloric acid over a period of 30 minutes with stirring under cooling with ice followed by stirring for one hour. The reaction mixture was neutralized with a 2N aqueous solution of sodium hydroxide under cooling with ice, and extracted three times with ethyl acetate. The extract was washed with a saturated aqueous solution of sodium chloride and dried with sodium sulfate, and ethyl acetate was distilled off under a reduced pressure. The residue was dissolved in 80 ml of acetonitrile, while stirring under cooling with ice 4.31 ml (37.1 mmol) of benzoyl chloride was added dropwise thereto, and then 3.43 ml (42.4 mmol) of pyridine was added dropwise thereto, followed by stirring for one hour. Then, pH of the mixture was adjusted to about 3 by adding 2N hydrochloric acid, water was added thereto, and the mixture was extracted with ethyl acetate. The extract was washed with a saturated aqueous solution of sodium chloride and dried with sodium sulfate, and ethyl acetate was distilled off under a reduced pressure. The residue was purified by silica gel chromatography to obtain 5.13 g (42%) of Compound 11a. 5.13 g (14.9 mmol) of Compound 11a was dissolved in 102 ml of acetonitrile, to the resulting solution was added dropwise 2.73 ml (29.7 mmol) of phosphorus oxychloride while refluxing by heating, and the mixture was further refluxed by heating for 30 minutes. The reaction solution was cooled with water, water was added thereto, neutralized with a 2N aqueous sodium hydroxide solution, and the mixture was extracted with ethyl acetate. The extract was dried with sodium sulfate, and ethyl acetate was distilled off under a reduced pressure. The residue was purified by silica gel chromatography to obtain 2.48 g (51%) of Coupler II-7).

SYNTHESIS EXAMPLE 4

Synthesis of Coupler II-32)

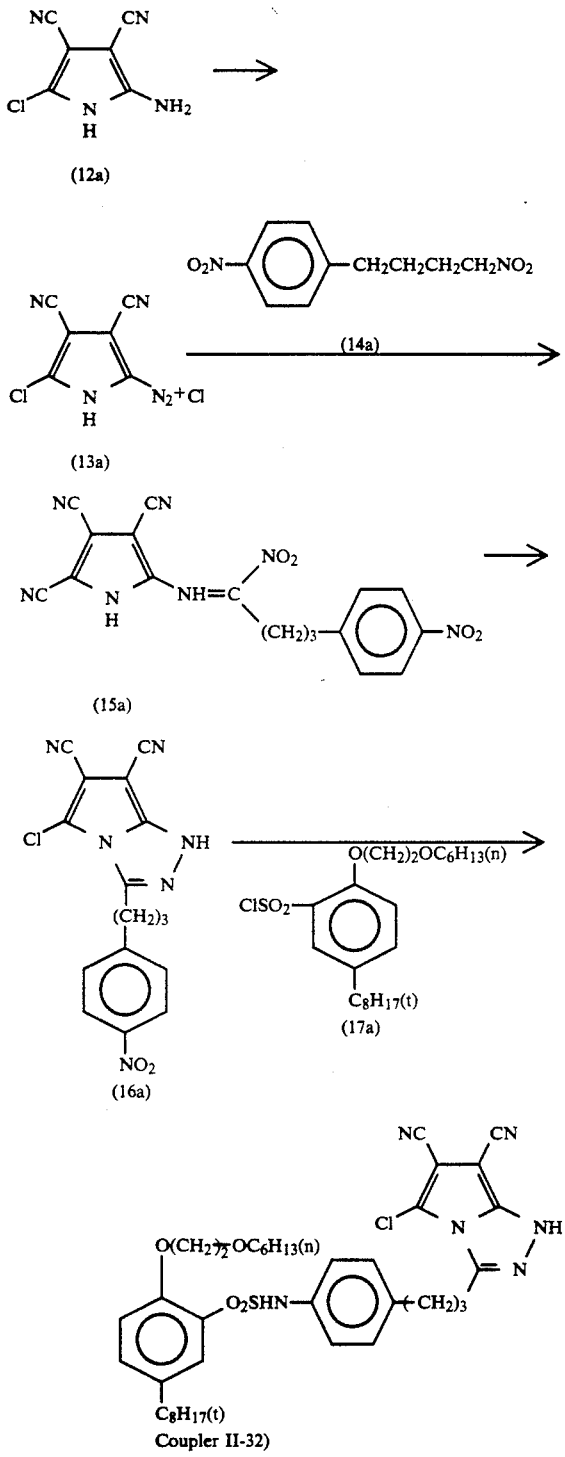

To 6.78 g (40.7 mmol) of 2-amino-5-chloro-3,4-dicyanopyrrole (Compound 12a) was added 38 ml of 36% hydrochloric acid, and a solution containing 2.95 g (42.7 mmol) of sodium nitrite in 5.9 ml of water was gradually added dropwise thereto with stirring under cooling with ice, followed by stirring for 1.5 hours to synthesis Compound 13a. To a solution containing 9.58 g (427 mmol) of Compound 14a in 177 ml of ethanol was added 102 ml of 28% sodium methylate with stirring under cooling with ice, and to the resulting solution was gradually added dropwise the solution of Compound 13a above with stirring under cooling with ice, followed by stirring for one hour. Then, the reaction solution was refluxed by heating with stirring for 1.5 hours, ethanol was distilled off under a reduced pressure therefrom and the residue was dissolved in chloroform. The solution was washed with a saturated aqueous solution of sodium chloride and dried with sodium sulfate, and chloroform was distilled off under a reduced pressure. The residue was purified by silica gel chromatography to obtain 4.19 g (29% based on Compound 12a) of Compound 16a.

Compound 12a used above was prepared by chlorination of 3,4-dicyanopyrrole, followed by nitration and reduction of the resulting nitro compound with iron. Compound 14a was prepared according to the method described in *Journal of the American Chemical Society*, Vol. 76, page 3,209 (1954) from Compound (a) prepared from γ-lactone and benzene in a known manner.

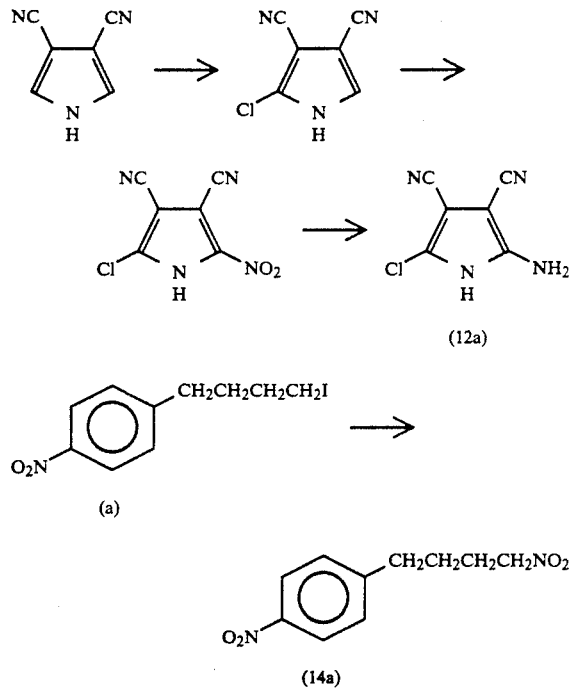

To 3.3 g (59.0 mmol) of reduced iron powder were added 10 ml of water, 0.3 g (5.9 mmol) of ammonium chloride and 0.34 ml (5.9 mmol) of acetic acid, the mixture was refluxed by heating with stirring for 15 minutes and 31 ml of isopropanol was added thereto, followed by refluxing by heating with stirring for 20 minutes. A solution containing 4.1 g (11.8 mmol) of Compound 16a in 14 ml of isopropanol was added dropwise thereto and the mixture was refluxed by heating with stirring for 2 hours. The reaction solution was filtered using sellaite as a filter aid, the residue was washed with ethyl acetate, and the solvent was distilled off under a reduced pressure. The residue was dissolved in a mixture of 16 ml of ethyl acetate and 24 ml of dimethylacetamide, to the resulting solution were added 5.6 g (13.0 mmol) of Compound 17a and then 8.2 ml (59.0 mmol) of triethylamine, and the mixture was stirred at room temperature for 4 hours. After adding water, the mixture was extracted with ethyl acetate. The extract was washed with a saturated aqueous solution of sodium chloride and dried with sodium sulfate, and the solvent was distilled off under a reduced pressure. The residue was purified by silica gel chromatography to obtain 6.46 g (76%) of Coupler II-32).

The cyan coupler according to the present invention forms a cyan dye image upon coupling with an oxidation product of an aromatic primary amine color developing agent.

REFERENCE EXAMPLE

The absorption spectrum of an ethyl acetate solution of Dye D obtained by oxidative coupling of Coupler II-5) according to the present invention with N-ethyl-N-(β-methanesulfonamidoethyl)-3-methyl-4-aminoaniline is shown in the drawing. The dye obtained has λmax at 641 nm and effective for a cyan image. Further, the subsidiary absorption around 420 nm is small and the absorption on the shorter wavelength side decreases sharply.

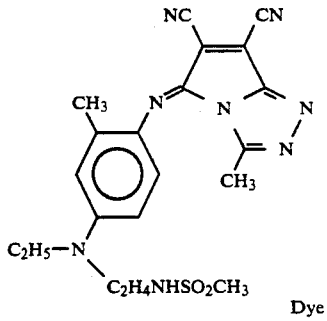

Dye D

When the cyan coupler according to the present invention is applied to a silver halide color photographic material, the photographic material has at least one layer containing the cyan coupler according to the present invention on a support. The layer containing the cyan coupler is a hydrophilic colloid layer on the support. A conventional color photographic material has at least one blue-sensitive silver halide emulsion layer, at least one green-sensitive silver halide emulsion layer and at least one red-sensitive silver halide emulsion layer on a support in this order. The order of these layers can be varied. Also, an infrared-sensitive silver halide emulsion layer may be employed in place of one of the above described light-sensitive layers. Silver halide emulsions sensitive to the respective wavelength ranges and color couplers capable of forming dyes having complementary color to the light to which the silver halide emulsion is sensitive are incorporated into the light-sensitive silver halide emulsion layers in order to achieve color reproduction by the subtractive color process. However, the above described relationship of the light-sensitive emulsion layer and hue of dye formed from the color coupler may be varied from that described above.

The coupler according to the present invention is preferably employed in a red-sensitive silver halide emulsion layer of a color photographic light-sensitive material.

The amount of cyan coupler according to the present invention incorporated into the photographic light-sensitive material is preferably from $1\times10^{-3}$ to 1 mol, more preferably from $2\times10^{-3}$ to $3\times10^{-1}$ mol, per mol of light-sensitive silver halide.

Further, when the cyan coupler according to the present invention is soluble in an alkaline aqueous solution, it is dissolved in an alkaline aqueous solution together with a developing agent and other additives and used in a color developing solution in a coupler-in-developer type dye image forming method. The amount of cyan coupler used in such a case is preferably from 0.0005 to 0.05 mol, more preferably from 0.005 to 0.02 mol, per liter of color developing solution.

The coupler according to the present invention can be incorporated into a photographic light-sensitive material using various known dispersing methods. Among them, an oil droplet-in-water type dispersing method wherein the coupler is dissolved in a high boiling point organic solvent, together with a low boiling point organic point, if desired, emulsified and dispersed in an aqueous gelatin solution, and then added to a hydrophilic colloid layer composition such as a silver halide emulsion is preferably employed.

Examples of high boiling point organic solvents which can be used in the oil droplet-in-water type dispersing method are described, for example, in U.S. Pat. No. 2,322,027. Furthermore, specific examples of the process and effect of the latex dispersing method as a polymer dispersion method, and of latexes for impregnating are described, for example, in U.S. Pat. No. 4,199,363, West German Patent Applications (OLS) 2,541,274 and 2,541,230, JP-B-53 41091 and European Patent Application (OPI) 029,104, and a dispersing method using an organic solvent soluble polymer is described in PCT International Patent Application (OPI) W088/00723.

Specific examples of high boiling point organic solvents which can be used in the above-described oil droplet-in-water type dispersing method include phthalic acid esters (for example, dibutyl phthalate, dioctyl phthalate, dicyclohexyl phthalate, di-2-ethylhexyl phthalate, didecyl phthalate, bis(2,4-di-tert-amylphenyl) isophthalate, or bis(1,1-diethylpropyl) phthalate, phosphoric acid or phosphonic acid esters (for example, diphenyl phosphate, triphenyl phosphate, tricresyl phosphate, 2-ethylhexyl diphenyl phosphate, dioctyl butyl phosphate, tricyclohexyl phosphate, tri-2-ethylhexyl phosphate, tridodecyl phosphate, or di-2-ethylhexyl phenyl phosphate), benzoic acid esters (for example, 2-ethylhexyl benzoate, 2,4-dichlorobenzoaate, dodecyl benzoate, or 2-ethylhexyl-p-hydroxybenzoate), amides (for example, N,N-diethyldodecanamide, or N,N-diethyllaurylamide), alcohols or phenols (for example, isostearyl alcohol, or 2,4-di-tert-amylphenol), aliphatic carboxylic acid esters (for example, dihexyldecyl succinate, di-2-ethylhexyl succinate, 2-hexyldecyl tetradecanate, tributyl citrate, diethyl azelate, isostearyl lactate, or trioctyl citrate), aniline derivatives (for example, N,N-dibutyl-2-butoxy-5-tert-octylaniline), chlorinated paraffins (paraffins which have a chlorine content of from 10 to 80%), trimesic acid ester (for example, tributyl trimesate), dodecylbenzene, diisopropylnaphthalene, phenols (for example, 2,4-di-tert-amulphenol, 4-dodecyloxyphenol, 4-dodecyloxycarbonylphenol or 4-(4-dodecyloxyphenylsulfonyl) phenol), carboxylic acids (for example, 2-(2,4-di-tert-amyylphenoxybutyric acid, or 2-ethoxyoctadecanoic acid), and alkyl phosphoric acids (for example, di-(2-ethylhexyl)phosphoric acid, diphenylphosphoric acid). Further, an organic solvent having a boiling point of from 30° C. to about 160° C., (for example, ethyl acetate, butyl acetate, ethyl propionate, methyl ethyl ketone, cyclohexanone, 2-ethoxyethyl acetate, or dimethylformamide can be employed as an auxiliary solvent together with the high boiling point organic solvent, if desired.

The high boiling point organic solvent is employed from 0 to 2.0 times by weight, preferably from 0 to 1.0 time by weight based on the coupler.

The cyan coupler according to the present invention can be applied to, for example, color papers, color reversal papers, direct positive color light-sensitive materials, color negative films, color positive films, and color reversal films. Among them, the use in color light-sensitive materials having a reflective support (for example, color papers, and color reversal papers) is preferred.

The silver halide emulsion used in the present invention can have any halogen composition. For example, a silver iodobromide, silver iodochlorobromide, silver bromide, silver chlorobromide or silver chloride emulsion may be used.

The preferred halogen composition differs depending on the type of light-sensitive material being used. With color papers, for example, a silver chlorobromide emulsion is mainly used, with light-sensitive materials for photography such as color negative films or color reversal films, a silver iodobromide emulsion containing form 0.5 to 30 mol %, preferably from 2 to 25 mol % of silver iodide is used, while with direct positive color light-sensitive materials, a silver bromide or silver chlorobromide emulsion is employed.

Furthermore, a so-called high silver chloride emulsion which has a high silver chloride content is preferably used in light-sensitive materials for color papers which are suitable for rapid processing. The silver chloride content of the high silver chloride emulsion is preferably at least 90 mol %, and most preferably at least 95 mol %.

Structures which have a stratified or non-stratified silver bromide localized phase either within the silver halide grain and/or at the grain surface as described above are preferred for such a high silver chloride emulsion. The halogen composition of the above described localized phase is preferably such that the silver bromide content is at least 10 mol %, and preferably more than 20 mol %. Hence, the localized phase can be present in the interior of grains, or on the edges, corners or planes of the surface of the grains, and in one preferred example, the localized phase is grown epitaxially on the corners of the grains.

In the present invention, a silver chlorobromide or silver chloride, each containing substantially no silver iodide, is particularly preferably used. The terminology "containing substantially no silver iodide" as used herein means that a silver iodide content in the silver halide is 1 mol % or less, preferably 0.2 mol % or less.

The halogen composition of the emulsion may be the same or different from grain to grain, but uniformity in the grains is facilitated when an emulsion in which the halogen composition is uniform from grain to grain is used. Furthermore, the grains of the silver halide emulsion can comprise grains which have a so-called uniform type structure in which the composition is the same in all parts of the grains of the silver halide emulsion, grains which have a so-called stratified structure in which the silver halide composition is different in -the interior core of the silver halide grains from that in the shell (which may be a single layer or a plurality of layers) which surrounds the core, or grains which have a part which has a different halogen composition in a non-stratified form either within the grains or on the grain surfaces (in the case of the grain surface, the structure is such that the part which has a different composition is junctioned on the edges, corners or planes of the grain). These can be selected appropriately and used. The use of either of the latter two types of grains rather than grains which have a uniform structure is advantageous in order to achieve high photographic speed, and these grains are also preferred from the standpoint of preventing pressure fog. Where the silver halide grains have a structure such as that described above, the boundary portion between the parts in which the halogen composition differs may be a distinct boundary, or mixed crystals may be formed with a composition difference and the boundary may be indistinct, or there may be a positively continuous change in the structure.

The average grain size of silver halide grains in the silver halide emulsion used in the present invention (the grain size being defined as a diameter of a circle having the same area as the projected area of the grain and being a number average) is preferably from 0.1 to 2 μm, particularly preferably from 0.15 to 1.5 μm. With respect to the grain size distribution, a so-called mono-dispersed emulsion in which the coefficient of variation (obtained by dividing the standard deviation of the grain size distribution by the average grain size) is 20% or less, and preferably 15% or less, is desirably used in the present invention. Furthermore, two or more mono-dispersed silver halide emulsions which have different grain sizes can be employed as a mixture in the same layer or in the form of superimposed layers for the purpose of obtaining wide tolerance.

The form of the silver halide grains used in the present invention may be a regular crystal form such as a cubic, tetradecahedral, or octahedral, form, or an irregular crystal form such as a spherical, or plate-like form, or it may be a form which is a composite of these crystal forms. Furthermore, tabular grains may be used.

The silver halide emulsion used in the present invention may be a so-called surface latent image type emulsion wherein latent images are formed mainly on the surface of grains or a so-called internal latent image type emulsion wherein the latent images are formed mainly in the interior of grains.

The silver halide photographic emulsion which can be used in the present invention can be prepared, using the methods for example, these described in *Research Disclosure* (RD), No. 17643 (December, 1978), pages 22 to 23, "I. Emulsion Preparation and Types", and ibid, No. 18716 (November 1979), page 648, P. Glafkides, *Chimie et Physique Photographique,* published by Paul Montel, 1967, in G. F. Duffin, *Photographic Emulsion Chemistry,* published by Focal Press, 1966, and V. L. Zelikmann et al., *Making and Coating Photographic Emulsions,* published by Focal Press, 1964.

The mono-dispersed emulsions described, for example, in U.S. Pat. Nos. 3,574,628 and 3,655,394, and British Patent 1,413,748 are preferably used.

Furthermore, tabular grains where the aspect ratio is at least about 5 can be used in the present invention. Tabular grains can be prepared easily using the methods described, for example, in Gutoff, *Photographic Science and Engineering,* Volume 14, pages 248 to 257 (1970), and U.S. Pat. Nos. 4,434,226, 4,414,310, 4,433,048 and 4,439,520, and British Patent 2,112,157.

The crystal structure may be uniform, or the interior and exterior of the grains may have different halogen compositions, or the grains may have a stratified structure and, moreover, silver halides which have different compositions may be joined with an epitaxial junction or they may be joined with compounds other than silver halides, such as silver thiocyanate or lead oxide.

Mixtures of grains which have various crystalline forms may be used.

The silver halide emulsions which are used have generally been subjected to physical ripening, chemical ripening and spectral sensitization.

During the step of formation or of physical ripening of silver halide grains of the silver halide emulsion used in the present invention, various kinds of multi-valent metal ion impurities can be introduced. Suitable examples of compounds providing these ions include cadmium salts, zinc salts, lead salts, copper salts, thallium salts, salts or complex salts of elements of Group VIII in the Periodic Table, for example, iron, ruthenium, rhodium palladium, osmium, iridium, and platinum.

Additives which are employed in the steps of physical ripening, chemical ripening and spectral sensitization of the silver halide emulsion used in the present invention are described in *Research Disclosure* Nos. 17643, 18716 and 307105, and relevant items are summarized in the table shown below.

Known photographic additives which can be used in the present invention are also described in the above described *Research Disclosure* references, and relevant items are also indicated in the table below.

| Kind of Additive | RD17643 | RD18716 | RD307105 |
|---|---|---|---|
| 1. Chemical Sensitizers | p. 23 | p. 648, right col. | p. 866 |
| 2. Sensitivity Increasing Agents | | -ditto- | |
| 3. Spectral Sensitizers and Supersensitizers | pp.23–24 | p. 648, right col. to p. 649, right col. | pp. 866–868 |
| 4. Whiteners | p. 24 | p. 647, right col. | p. 868 |
| 5. Antifoggants and Stabilizers | pp. 24–25 | p. 649, right col. | pp. 868–870 |
| 6. Light Absorbents, Filter Dyes, and UV Absorbents | pp. 25–26 | p. 649, right col. to p. 650, left col. | p.873 |
| 7. Antistaining Agents | p. 25, right col. | p. 650, left to right cols. | p. 872 |
| 8. Dye Image Stabilizers | p. 25 | p. 650, left col. | p. 872 |
| 9. Hardeners | p. 26 | p. 651, left col. | pp. 874–875 |
| 10. Binders | p. 26 | ditto | pp. 873–874 |
| 11. Plasticizers and Lubricants | p. 27 | p. 650, right col. | p. 876 |
| 12. Coating Aids and Surfactants | pp. 26–27 | p. 650, right col. | pp. 875–876 |
| 13. Antistatic Agents | p. 27 | -ditto- | pp. 876–877 |
| 14. Matting Agents | | | pp. 878–879 |

Furthermore, the addition of the compounds which react with and fix formaldehyde as described in U.S. Pat. Nos. 4,411,987 and 4,435,503 to the light-sensitive material is desirable for preventing degradation of photographic performance due to contact with formaldehyde gas.

Various color couplers can be used in the present invention, and specific examples thereof are described in the patents cited in *Research Disclosure* (RD) No. 17643, VII-C to G and ibid., No. 307105, VII-C to G described above.

Those color couplers described, for example, in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and European Patent 249,473A are preferred as yellow couplers. (The term "JP-B" as used herein means an "examined Japanese patent publication".)

It is preferred for the cyan coupler according to the present invention to .use in combination with a yellow coupler which forms a colored dye having the maximum absorption wavelength on the shorter wavelength side and a sharply reduced absorption in the longer wavelength region of 500 nm or longer from the standpoint of color reproducibility. Such yellow couplers are described, for example, in JP-A-63-123047.

5-Pyrazolone compounds and pyrazoloazole compounds are preferred as magenta couplers, and those disclosed, for example, in U.S. Pat. Nos. 4,310,619 and 4,351,897, European Patent 73,636, U.S. Pat. Nos. 3,061,432 and 3,725,067, *Research Disclosure* No. 24220 (June 1984), JP-A-60-33552, *Research Disclosure* No. 24230 (June 1984), JP-A-60-43659, JP-A-61-72238, JP-A60-35730, JP-A-55-118034, JP-A-60-185951, U.S. Pat. Nos. 4,500,630, 4,540,654 and 4,556,630, and International Patent WO 88/04795 are especially preferred.

Phenol and naphthol couplers are examples of cyan couplers which can be used in combination in the present invention with the cyan coupler according to the present invention, and those phenol and naphthol couplers described, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West- German Patent (Laid Open) 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658 are preferred.

Colored couplers for correcting undesirable absorption of colored dyes described, for example, in VII-G of *Research Disclosure,* No. 17643, U.S. Pat. No. 4,163,670, JP-B-57-39413, U.S. Pat. Nos. 4,004,929 and 4,138,258, and British Patent 1,146,368 are preferred. Furthermore, the use of couplers which correct for unwanted absorption of colored dyes using fluorescent dyes which are released on coupling as described in U.S. Pat. No. 4,774,181, and couplers which have, as a coupling-off group, a dye precursor group capable of forming a dye on reaction with the developing agent described in U.S. Pat. No. 4,777,120 are also preferred.

The couplers described in U.S. Pat. No. 4,366,237, British Patent 2,125,570, European Patent 96,570 and West German Patent (Laid Open) 3,234,533 are preferred as couplers where the colored dyes have an appropriate degree of diffusibility.

Typical examples of polymerized dye forming couplers are described, for example, in U.S. Pat. Nos. 3,451,820, 4,080,211, 4,367,282, 4,409,320 and 4,576,910, and British Patent 2,102,137.

Couplers which release photographically useful groups on coupling are also preferred in the present invention. DIR couplers which release development inhibitors described in the patents cited in VII-F of *Research Disclosure,* No. 17643, JP-A-57-151944, JP-A-57-154234, JP-A-60-184248, JP-A-63-37346, and U.S. Pat. Nos. 4,248,962 and 4,782,012 are preferred.

The couplers described in British Patents 2,097,140 and 2,131,188, JP-A-59-157638 and JP-A-59-170840 are preferred as couplers which release nucleating agents or development accelerators in correspondence with the image formation during development.

Other couplers which can be used in photographic light-sensitive material of the present invention include the competing couplers described, for example, in U.S. Pat. No. 4,130,427, the multi-equivalent couplers described, for example, in U.S. Pat. Nos. 4,283,472, 4,338,393 and 4,310,618, the DIR redox compound releasing couplers, DIR coupler releasing couplers, DIR coupler releasing redox compounds or DIR redox compound releasing redox compounds described, for example, in JP-A-60-185950 and JP-A-62-24252, the couplers which release dyes of which the color is restored after released described in European Patent 173,302A, the bleach accelerator releasing couplers described, for example, in *Research Disclosure*, No. 11449 and ibid, No. 24241, and JP-A-61-201247, the ligand releasing couplers described, for example, in U.S. Pat. No. 4,553,477, the leuco dye releasing couplers described in JP-A-63-75747, and the couplers which release fluorescent dyes described in U.S. Pat. No. 4,774,181.

The standard amount of color coupler which is used is in a range of from 0.001 to 1 mol per mol of light-sensitive silver halide, and the yellow coupler is preferably used in an amount of from 0.01 to 0.5 mol per mol of light-sensitive silver halide, the magenta coupler is preferably used in an amount of from 0.003 to 0.3 mol per mol of light-sensitive silver halide and the cyan coupler is preferably used in an amount of from 0.002 to 0.3 mol per mol of light-sensitive silver halide.

These couplers which may be used in combination with the coupler according to the present invention can be introduced into the photographic light-sensitive material by various known dispersing methods as described above.

The light-sensitive material according to the present invention may contain, for example, hydroquinone derivatives, aminophenol derivatives, gallic acid derivatives and ascorbic acid derivatives as color fog preventing agents.

Various color fading preventing agents can also be used in the light-sensitive material of the present invention. More specifically, hydroquinones, 6-hydroxychromans, 5-hydroxycoumarans, spirochromans p-alkoxyphenols, hindered phenols such as bisphenols, gallic acid derivatives, mathylenedioxybenzenes, aminophenols, hindered amines, and ether and ester derivatives in which the phenolic hydroxyl groups of these compounds have been silylated or alkylated are typical organic color fading preventing agents which can be used for cyan, magenta and/or yellow images. Furthermore, metal complexes typically exemplified by (bis-salicylaldoximato) nickel and (bis-N,N-dialkyldithiocarbamato) nickel complexes, for example, can also be used for such a purpose.

Specific examples of organic color fading preventing agents are described in the patent specifications set forth below.

More specifically, hydroquinones are described, for example, in U.S. Pat. Nos. 2,360,290, 2,418,613, 2,700,453, 2,701,197, 2,728,659, 2,732,300, 2,735,765, 3,982,944 and 4,430,425, British Patent 1,363,921 and U.S. Pat. No. 2,710,801 and 2,816,028, 6-hydroxychromans, 5-hydroxychromans and spirochromans are described, for example, in U.S. Pat. Nos. 3,432,300, 3,573,050, 3,574,627, 3,698,909 and 3,764,337, and JP-A-52-152225, spiroindanes are described in U.S. Pat. No. 4,360,589, p-alkoxyphenols are described, for example, in U.S. Pat. No. 2,735,765, British Patent 2,066,975, JP-A-59-10539 and JP-B-57-19765, hindered phenols are described, for example, in U.S. Pat. Nos. 3,700,455 and 4,228,235, JP-A-52-72224, and JP-B-52-6623, gallic acid derivatives are described, for example, in U.S. Pat. No. 3,457,079, methylenedioxybenzenes and aminophenols are described, for example, in U.S. Pat. Nos. 3,457,079 and 4,332,886, and JP-B-56-21144 respectively, hindered amines are described, for example, in U.S. Pat. Nos. 3,336,135 and 4,268,593, British Patents 1,326,889, 1,354,313 and 1,410,846, JP-B-51-1420, JP-A-58-114036, JP-A-59-53846 and JP-A-59-78344, and metal complexes are described, for example, in U.S. Pat. Nos. 4,050,938 and 4,241,155, and British Patent 2,027,731(A). These compounds can be added to the light-sensitive layer after co-emulsification with the corresponding color coupler, generally in an amount of from 5 to 100 wt % with respect to the coupler. The incorporation of ultraviolet light absorbers in the cyan color forming layer and in layers on both sides adjacent thereto is effective for the purpose of preventing a deterioration of the cyan dye image due to heat and, more especially, due to light.

For example, benzotriazole compounds substituted with aryl groups (for example, those described in U.S. Pat. No. 3,533,794), 4-thiazolidone compounds (for example, those described in U.S. Pat. Nos. 3,314,794 and 3,352,681), benzophenone compounds (for example, those described in JP-A-46-2784), cinnamic acid ester compounds (for example, those described in U.S. Pat. Nos. 3,705,805 and 3,707,395), butadiene compounds (for example, those described in U.S. Pat. No. 4,045,229), or benzoxazole compounds (for example, those described in U.S. Pat. Nos. 3,406,070 and 4,271,307) can be used as ultraviolet light absorbers. Ultraviolet light absorbing couplers (for example, α-phenolic type cyan dye forming couplers) and ultraviolet light absorbing polymers may also be used for such a purpose. These ultraviolet light absorbers may be mordanted in a specific layer, if desired.

Of these compounds, the above-described benzotriazole compounds substituted with aryl groups are preferred.

Gelatin is advantageously used as a binder or protective colloid in the emulsion layer of the light-sensitive material of the present invention, but other hydrophilic colloids, either alone or in combination with gelatin, can be used.

The gelatin used in the present invention may be lime treated gelatin, or it may be gelatin which has been treated with acids. Details of the preparation of gelatin are described in Arther Weiss, *The Macromolecular Chemistry of Gelatin* (published by Academic Press, 1964).

The addition of various antiseptics and antimolds such as 1,2-benzisothiazolin-3-one, n-butyl p-hydroxybenzoate, phenol, 4-chloro-3,5-dimethylphenol, 2-phenoxyethanol and 2-(4-thiazolyl)benzimidazole as described in JP-A-63-257747, JP-A-62-272248 and JP-A-1-80941 to the light-sensitive material of the present invention is preferred.

When the photographic light-sensitive material according to the present invention is a direct positive color light-sensitive material, nucleating agents such as hydrazine compounds or quaternary heterocyclic compounds as described in *Research Disclosure,* No. 22534 (January, 1983), and nucleation accelerating agents which facilitate the effect of the nucleating agents can be employed.

Suitable supports used in the present invention, are those conventionally employed in photographic light-sensitive materials, for example, transparent films such as cellulose nitrate films and polyethylene terephthalate films, or reflective supports. For the purpose of the present invention, reflective supports are preferably employed.

The term "reflective support", which is preferably employed in the present invention, means a support having an increased reflection property for the purpose of producing clear dye images in the silver halide emulsion layer. Examples of reflective supports include a support having coated thereon a hydrophobic resin containing a light reflective substance such as titanium oxide, zinc oxide, calcium carbonate, or calcium sulfate dispersed therein and a support composed of a hydrophobic resin containing a light reflective substance dispersed therein. More specifically, they include baryta coated paper; polyethylene coated paper; polypropylene type synthetic paper; transparent supports, for example, a glass plate, a polyester film such as a polyethylene terephthalate film, a cellulose triacetate film or a cellulose nitrate film, a polyamide film, a polycarbonate film, a polystyrene film, or a vinyl chloride resin, having a reflective layer or with a reflective substance incorporated therein.

The photographic light-sensitive material according to the present invention can be subjected to development processing in a conventional manner as described in *Research Disclosure,* No. 17643, pages 28 to 29 and ibid., No. 18716, page 615, left column to right column. For instance, color development processing includes a color development step, a desilvering step and a water washing step. Reversal development processing includes a black-and-white development step, a water washing or rinse step, a reversal step and a color development step. The desilvering step can be conducted by a bleach-fixing step using a bleach-fixing solution in place of a bleaching step using a bleaching solution and a fixing step using a fixing solution. The bleaching step, fixing step and bleach-fixing step may be employed in any appropriate order. Instead of a water washing step, a stabilizing step can be performed, or a stabilizing step can be conducted after the water washing step. Moreover, a mono-bath processing step using a mono-bath development-bleach-fixing solution wherein color development, bleaching and fixing are conducted in a mono-bath may be employed. Furthermore, a pre-hardening step, a neutralizing step therefor, a stop-fixing step, an after-hardening step, a controlling step or an intensifying step may be conducted in combination with the above described processing steps. An intermediate water washing step may be appropriately used between the above described steps. A so-called activator processing step may be performed in place of the color development step in the above described processing steps.

The color developing solution used in the development processing of the light-sensitive material of the present invention is an aqueous alkaline solution which contains an aromatic primary amine color developing agent as the principal component. An aminophenol compound is also useful as a color developing agent, but the use of a p-phenylenediamine compound is preferred. Typical examples of these compounds include 3-methyl-4-amino-N,N-diethylaniline, 3-methyl-4-amino-N-ethyl-N-$\beta$-hydroxyethylaniline, 4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, and the sulfate, hydrochloride and p-toluenesulfonate salts of these compounds. Two or more of these compounds can be used in combination, if desired.

The color developing solution generally contains pH buffers such as alkali metal carbonates, borates or phosphates, and development inhibitors or anti-foggants such as chlorides, bromides, iodides, benzimidazoles, benzothiazoles or mercapto compounds. It may also contain, if desired, various preservatives, for example, hydroxylamine, diethylhydroxylamine, sulfites, hydrazines such as N,N-biscarboxymethylhydrazine, phenylsemicarbazides, triethanolamine and catecholsulfonic acids, organic solvents such as ethylene glycol and diethylene glycol, development accelerators such as benzyl alcohol, polyethylene glycol, quaternary ammonium salts and amines, dye forming couplers, competing couplers, auxiliary developing agents such as 1-phenyl-3-pyrazolidone, nucleating agents such as sodium borohydride and hydrazine compounds, thickeners, and various chelating agents typically exemplified by aminopolycarboxylic acids, aminopolyphosphonic acids, alkylphosphonic acids and phosphonocarboxylic acids, for example, ethylenediamine tetraacetic acid, nitrilotriacetic acid, diethylenetriamine pentaacetic acid, cyclohexanediamine tetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di-(o-hydroxyphenylacetic acid) and salts thereof, fluorescent brightening agents such as 4,4'-diamino-2,2'-disulfostilbene compounds, and various surface active agents such as alkylsulfonic acids, aryl sulfonic acids, aliphatic carboxylic acids and aromatic carboxylic acids.

According to the present invention, it is preferred to use a color developing solution which does not substantially contain benzyl alcohol. The terminology "color developing solution which does not substantially contain benzyl alcohol" as used herein means that the color developing solution contains preferably 2 ml or less, more preferably 0.5 ml or less, and most preferably no benzyl alcohol, per liter of the solution.

The color developing solution used in the present invention preferably does not substantially contain sulfite ion. The terminology "color developing solution which does not substantially contain sulfite ion" as used herein means that the color developing solution has preferably a sulfite ion concentration of $3.0\times10^{-3}$ mol or less per liter of the solution. It is most preferred that the color developing solution does not contain any sulfite ion at all.

The color developing solution used in the present invention preferably does not substantially contain hydroxylamine. The terminology "color developing solution which does not substantially contain hydroxylamine" as used herein means that the color developing solution has preferably a hydroxylamine concentration of $5.0\times10^{-3}$ mol or less per liter of solution. It is more preferred that the color developing solution does not contain any hydroxylamine at all.

The color developing solution used in the present invention preferably contains an organic preservative other than hydroxylamine (for example, a hydroxylamine derivative and a hydrazine derivative such as those disclosed in JP-A-3-121450).

The color developing solution used in the present invention has a pH which ranges ordinarily from 9 to 12.

In case of color reversal development processing, a black-and-white development step, water washing or rinse step, a reversal step and a color development step are conducted. The reversal step can be performed by treatment with a reversal solution containing a fogging agent or a light reversal treatment. Further, the reversal step may be omitted by incorporating a fogging agent into the color developing solution.

A black-and-white developing solution used in the black-and-white development step can be a conventionally known solution for processing a black-and-white photographic light-sensitive material, and contains various additives which are generally added to black-and-white developing solutions.

Representative examples of additives include developing agents such as 1-phenyl-3-pyrazolidone, N-methyl-p-aminophenol and hydroquinone; preservatives such as sulfites; pH buffers composed of water-soluble acids such as acetic acid and boric acid; pH buffers or development accelerators composed of alkalis such as sodium hydroxide, sodium carbonate and potassium carbonate; inorganic or organic development inhibitors such as potassium bromide, 2-methylbenzimidazole and methylbenzothiazole; water softeners such as ethylenediaminetetraacetic acid and polyphosphates; antioxidants such as ascorbic acid and diethanolamine; organic solvents such as triethylene glycol and cellosolve; and surface over-development preventing agents such as a slight amount of iodide and mercapto compounds.

Prevention of evaporation and aerial oxidation of the solution by reducing the area of contact with air in the processing tank is desirable in those cases where the replenishment rate of the developing solution is reduced. Means for reducing the area of contact with air in the processing tank include a method wherein a shield such as a floating over is provided on the surface of processing solution in the processing tank. It is preferred to use such a technique for reducing the open area not only to the color development and black-and-white development steps but also to all other subsequent steps. Further, the amount of replenishment can be reduced by suppressing the accumulation of bromide ion in the developing solution, for example, regeneration means.

The processing time of color development step is usually within the range of from 2 to 5 minutes. However, it is possible to reduce the processing time by conducting the color development at high temperature and high pH using a high concentration of color developing agent.

The photographic material is generally subjected to a desilvering process after color development. The desilvering process includes a bleaching process and a fixing process, and they may be carried out at the same time (in a bleach-fix process) or they may be carried out as a separate process. Further, a bleach-fix process can be carried out after a bleaching process in order to speed up the processing. Moreover, a bleach-fixing process can be carried out in two connected bleach-fixing baths, a fixing process can be carried out before a bleach-fixing process or a bleaching process can be carried out after a bleach-fix process depending on the intended purposes. In the present invention, the effects of the present invention can be achieved by immediately conducting a bleach-fixing process after color development.

Compounds of multi-valent metals such as iron(III), peracids, quinones and iron salts can be used as bleaching agents for the bleaching solution or bleach-fixing solution. Typical bleaching agents include iron chlorides; ferricyanides; bichromates; organic complex salts of iron(III), for example, complex salts of aminopolycarboxylic acids such as ethylenediamine tetraacetic acid, diethylenetriamine pentaacetic acid, or 1,3-diaminopropane tetraacetic acid; and persulfates. Among them, aminopolycarboxylic acid iron (III) complex salts are preferred from the standpoint of effectively achieving the effects of the present invention. Moreover, aminopolycarboxylic acid iron(III) complex salts are especially useful in both the bleaching solution and the bleach-fixing solution. The pH of the bleaching solution or bleach-fixing solution in which these aminopolycarboxylic acid iron(III) complex salts are used is normally from 3.5 to 8.

The bleaching solution or bleach-fixing solution used in the present invention can contain various known additives, for example, rehalogenating agents such as ammonium bromide or ammonium chloride; pH buffers such as ammonium nitrate; and metal corrosion preventing agents such as ammonium sulfate.

In addition to the compounds described above, an organic acid is added to the bleaching solution or bleach-fixing solution for the purpose of preventing bleaching stain. Particularly preferred organic acids are those having an acid dissociation constant (pKa) of from 2 to 5.5, and include specifically acetic acid or propionic acid.

Thiosulfates, thiocyanates, thioether compounds, thioureas and a large amount of iodide can be used as fixing agents in the fixing solution or bleach-fixing solution, but thiosulfates are normally used, and ammonium thiosulfate in particular can be used in the widest range of applications.

Further, a combination of a thiosulfate with a thiocyanate, a thioether compound or a thiourea is preferably used.

Sulfites, bisulfites, carbonyl bisulfite adducts or sulfinic acid compounds as described in European Patent 294,769A are preferably used as preservatives for the fixing solution or bleach-fixing solution. Further, various aminopolycarboxylic acids or organic phosphonium acids (for example, 1-hydroxyethylidene-1,1-diphosphonic acid, or N,N,N',N'-ethylenediaminetetraphosphonic acid) are preferably added to the fixing or bleach-fixing solution for the purpose of stabilizing the solution.

Further, various kinds of fluorescent brightening agent, defoaming agents, surface active agents, polyvinyl pyrrolidone, or methanol may be incorporated into the fixing solution or bleach-fixing solution.

Bleach accelerators can be used, if desired, in the bleaching solution, bleach-fixing solution or prebath thereof. Specific examples of useful bleach accelerators include compounds which have a mercapto group or a disulfide group as described, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426 and *Research Disclosure,* No. 17129 (July, 1978); the thiazolidine derivatives described in JP-A-50-

140129; the thiourea derivatives described in JP-B-45-8506, JP-A-52-20832, JP-A-53-32735 and U.S. Pat. No. 3,706,561, the iodides described in West German Patent 1,127,715 and JP-A-58-16235; the polyoxyethylene compounds described in West German Patents 966,410 and 2,748,430; polyamine compounds described in JP-B-45-8836; compounds described in JP-A-49-42434, JP-A-49-59644, JP-A-53-94927, JP-A-54-35727, JP-A-55-26506 and JP-A-58-163940; and bromide ion. Of these compounds, those which have a mercapto group or a disulfide group are preferred because of their large accelerating effect, and the compounds described in U.S. Pat. No. 3,893,858, West German Patent 1,290,812 and JP-A-53-95630 are especially preferred. Moreover, the compounds described in U.S. Pat. No. 4,552,834 are also preferred. These bleach accelerators may also be added to the light-sensitive material, if desired. These bleach accelerators are especially effective when conducting bleach-fixing of color photographic light-sensitive materials for photographing.

The shorter the total time of the desilvering step is more preferable so long as inferior desilvering does not occur. Thus, the processing time for the desilvering step is preferably from 1 to 3 minutes. The processing temperature is usually from 25° to 50° C., preferably from 35° to 45° C.

In the desilvering step, it is preferred to perform stirring as strongly as possible. Specific examples of methods for enhancing stirring include a method wherein the processing solution is jetted against the emulsion surface of the light-sensitive material as described in JP-A-62-183460. Such means for enhancing stirring are effective in any of the bleaching solution, bleach-fixing solution and fixing solution.

The silver halide photographic material according to the present invention is usually subjected to a water washing step after the desilvering step. In place of the water washing step, a stabilizing step can be performed. Known methods as described, for example, in JP-A-57-8543, JP-A-58-14834 and JP-A-60-220345 can be employed as a stabilizing step. Further, a water washing step-stabilizing step using as the final bath a stabilizing bath containing a dye stabilizer and a surface active agent which is typically employed for processing color photographic light-sensitive materials for photographing can be employed.

Water softeners such as inorganic phosphonic acids, polyaminocarboxylic acids or organic aminophosphonic acids; sterilizers such as isothiazolone compounds, thiabendazoles or chlorine type sterilizers, for example, sodium chlorinated isocyanurate; metal salts such as Mg-salts, Al-salts or Bi-salts; surface active agents; hardeners; and sterilizers may be incorporated into the water washing solution or stabilizing solution.

The amount of water required for the water washing step may be set in a wide range depending on the characteristics of the photographic light-sensitive materials (due to elements used therein, for example, couplers), uses thereof, temperature of the washing water, the number of water washing tanks (stages), a replenishment system such as countercurrent or normal current used, or other various conditions. The relationship between a number of water washing tanks and the amount of water in a multi-stage countercurrent system can be determined based on the method as described in *Journal of the Society of Motion Picture and Television Engineers,* Vol. 64, pages 248 to 253 (May, 1955). Further, in the present invention, a method for reducing the amount of calcium and magnesium as described in JP-A-62-288838 can be particularly effectively employed.

The pH of the washing water when processing the light-sensitive material of the present invention is from 4 to 9, and preferably from 5 to 8. The washing water temperature and the water washing time can be widely varied depending on the characteristics of or the use of the light-sensitive material but, in general, water washing conditions of from 20 seconds to 10 minutes at a temperature of from 15° C. to 45° C., and preferably of from 30 seconds to 5 minutes at a temperature of from 25° C. to 40° C., are used.

Dye stabilizers used in the stabilizing solution include aldehydes such as formaldehyde or glutaraldehyde, N-methylol compounds such as dimethylol urea, hexamethylenetetramine and aldehyde sulfite adducts. pH controlling buffers such as boric acid or sodium hydroxide; chelating agents such as 1-hydroxy-ethylidene-1,1-diphosphonic acid or ethylenediaminetetraacetic acid; sulfurization preventing agents such as alkanolamines; fluorescent brightening agents; and antimolds may be added to the stabilizing solution.

The overflow solution resulting from replenishment of the above described water washing or stabilizing solution can be reused in other steps, such as in the de-silvering step.

A color developing agent can be incorporated into the silver halide light-sensitive material of the present invention to simplify and speed up processing. The incorporation of various color developing agent precursors is preferred. For example, the indoaniline compounds described in U.S. Pat. No. 3,342,597, the Schiff's base compounds described in U.S. Pat. No. 3,342,599 and *Research Disclosure,* No. 14850 and ibid, No. 15159, the aldol compounds described in *Research Disclosure,* No. 13924, the metal complex salts described in U.S. Pat. No. 3,719,492 and the urethane type compounds described in JP-A-53-135628 can be used for this purpose.

Various 1-phenyl-3-pyrazolidones can also be incorporated, if desired, into the silver halide light-sensitive material of the present invention to accelerate color development. Typical compounds of this type have been described, for example, in JP-A-56-64339, JP-A-57-144547 and JP-A-58-115438.

The various processing solutions used in the present invention are emplyed at a temperature of from 10° C. to 50° C. A standard temperature is generally from 33° C. to 38° C., but rapid processing and a shorter processing time can be achieved at a higher temperature while, on the other hand, improved image quality and improved processing solution stability can be achieved at a lower temperature.

The present invention is described in greater detail with reference to the following examples, but the present invention is not to be construed as being limited to these examples.

EXAMPLE 1

Preparation of Sample 101

Sample 101 having the layer construction shown below on a cellulose triacetate film base was prepared.

The coating solution for the First Layer was prepared in the following manner.

1.01 g of Cyan Coupler (ExC) and 1.0 g of dibutyl phthalate was thoroughly dissolved in 10.0 ml of ethyl acetate. The resulting ethyl acetate solution of coupler was added to 42 g of a 10% aqueous gelatin solution (containing 5 g/l of sodium dodecylbenzenesulfonate), and the mixture was emulsified and dispersed by a homogenizer. Distilled water was added to the emulsified dispersion to make the total amount to 100 g. 100 g of the emulsified dispersion and 8.2 g of a red-sensitive high silver chloride content AgBrCl emulsion (silver bromide content: 0.5 mol %) containing $1.0\times10^{-4}$ mol of the Red-sensitive Sensitizing Dye E shown below per mol of silver halide were mixed, and a coating solution of or the First Layer having the composition shown below was prepared. 1-Oxy-3,5-dichloro-s-triazine sodium salt was used as a gelatin hardener.

Cyan Coupler (ExC)

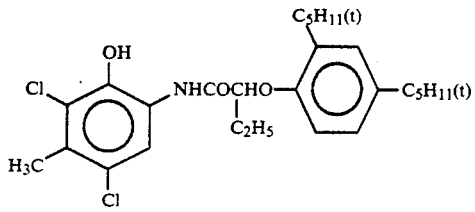

Sensitizing Dye for Red-Sensitive Emulsion

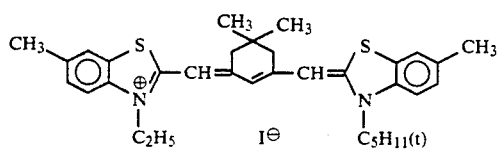

The layer construction is shown below.

| | |
|---|---|
| Support: | |
| Cellulose triacetate film | |
| First Layer (Emulsion Layer): | |
| Silver Halide in Red-Sensitive High Silver Chloride Content Emulsion | 0.86 g/m$^2$ (as silver) |
| Gelatin | 2.50 g/m$^2$ |
| Cyan Coupler (ExC) | 0.49 g/m$^2$ |
| Dibutyl Phosphate | 0.75 g/m$^2$ |
| Second Layer (Protective Layer): | 1.60 g/m$^2$ |
| Gelatin | |

Preparation of Samples 102 to 114

Samples 102 to 114 were prepared in the same manner as described for Sample 101, except for using an equimolar amount of each of the cyan couplers as shown in Table 1 below in place of Cyan Coupler (ExC), respectively.

Samples 101 to 114 thus prepared were exposed to white light through a continuous wedge and subjected to development processing according to the processing steps shown below.

After the development processing, each sample was subjected to density measurement to obtain the characteristic curve (log E vs cyan density). From the characteristic curve, the value of the logarithm (log E) of the exposure amount necessary for obtaining a density of fog +0.2 was determined as the sensitivity, and a relative value thereof was calculated taking the value for Sample 101 as 100.

Also, the maximum density was determined and its relative value was calculated again taking the value for Sample 101 as 100.

The greater these values, the higher the sensitivity and color density.

The results obtained are summarized in Table 1 below.

| Processing Step | Temperature (°C.) | Time (sec) |
|---|---|---|
| Color Development | 38 | 45 |
| Bleach-Fixing | 35 | 45 |
| Rinse (1) | 35 | 30 |
| Rinse (2) | 35 | 30 |
| Rinse (3) | 35 | 30 |
| Drying | 80 | 60 |

The rinse steps were conducted using a three-tank countercurrent system from Rinse (3) to Rinse (1).

The composition of each processing solution used is set forth below.

Color Developing Solution

| | |
|---|---|
| Water | 800 ml |
| Ethylenediamine-N,N,N,N-tetramethylenephosphonic acid | 3.0 g |
| Triethanolamine | 8.0 g |
| Potassium Chloride | 3.1 g |
| Potassium Bromide | 0.015 g |
| Potassium Carbonate | 25 g |
| Hydrazinodiacetic Acid | 5.0 g |
| N-Ethyl-N-(β-methanesulfonamidoethyl)-3-methyl-4-aminoaniline Sulfate | 5.0 g |
| Fluorescent Brightening Agent (WHITEX 4 manufactured by Sumitomo Chemical Co., Ltd.) | 2.0 g |
| Water to make | 1000 ml |
| pH | 10.50 |

The pH was adjusted with potassium hydroxide.

Bleach-Fixing Solution

| | |
|---|---|
| Water | 400 ml |
| Ammonium Thiosulfate Solution (700 g/l) | 100 ml |
| Ammonium Sulfite | 45 g |
| Ammonium iron (III) Ethylenediaminetetraacetate | 55 g |
| Ethylenediaminetetraacetic Acid | 3 g |
| Ammonium Bromide | 30 g |
| Nitric Acid (67%) | 27 g |
| Water to make | 1000 ml |
| pH | 5.8 |

Rinse Solution

Ion-exchange water (calcium and magnesium contents: 3 ppm, respectively)

TABLE 1

| Sample No. | Coupler | Relative Sensitivity | Maximum Density (relative value) | Remarks |
|---|---|---|---|---|
| 101 | ExC | 100 | 100 | Comparison |
| 102 | I-16) | 132 | 182 | Present Invention |
| 103 | I-20) | 128 | 180 | " |
| 104 | I-21) | 127 | 180 | " |
| 105 | I-28) | 118 | 185 | " |
| 106 | I-31) | 133 | 185 | " |

TABLE 1-continued

| Sample No. | Coupler | Relative Sensitivity | Maximum Density (relative value) | Remarks |
|---|---|---|---|---|
| 107 | I-32) | 120 | 186 | " |
| 108 | II-9) | 123 | 175 | " |
| 109 | II-10) | 125 | 173 | " |
| 110 | II-11) | 126 | 175 | " |
| 111 | II-13) | 125 | 176 | " |
| 112 | II-18) | 115 | 180 | " |
| 113 | II-19) | 129 | 181 | " |
| 114 | II-20) | 122 | 179 | " |

From the results shown in Table 1 above, it can be seen that the couplers according to the present invention provide high sensitivity and high color density in comparison with the comparative coupler. Since the couplers according to the present invention provide extremely high color density, the coating amount necessary to obtain the desired density can be markedly reduced.

EXAMPLE 2

Samples 201 to 214 were prepared in the same manner as described in Example 1 except for using a red-sensitive silver iodobromide emulsion (iodide content: 8.0 mol %) containing $6.9\times10^{-5}$ mol of the Red-sensitive Sensitizing Dye F shown below per mol of silver halide in place of the red-sensitive high silver chloride content emulsion.

Red-sensitive Sensitizing Dye F

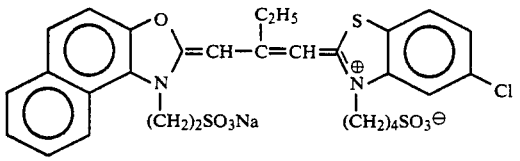

Samples 201 to 214 thus prepared were exposed and subjected to development processing according to the processing steps shown below.

As a result of the evaluations of the samples thus processed in the same manner as described in Example 1, it was confirmed that the sensitivity and high color density were obtained same as in Example 1. Particularly, an extremely high density was obtained as in Example 1.

| Processing Step | Processing Time | Processing Temperature (°C.) |
|---|---|---|
| Color Development | 3 min. 15 sec. | 38 |
| Bleaching | 1 min. 00 sec. | 38 |
| Bleach-Fixing | 3 min. 15 sec. | 38 |
| Washing with Water (1) | 40 sec. | 35 |
| Washing with Water (2) | 1 min. 00 sec. | 35 |
| Stabilizing | 40 sec. | 38 |
| Drying | 1 min. 15 sec. | 55 |

The composition of each processing solution used is illustrated below.

Color Developing Solution

| | |
|---|---|
| Diethylenetriaminepentaacetic Acid | 1.0 g |
| 1-Hydroxyethylidene-1,1-diphosphonic | 3.0 g |

-continued

| | |
|---|---|
| Acid | |
| Sodium Sulfite | 4.0 g |
| Potassium Carbonate | 30.0 g |
| Potassium Bromide | 1.4 g |
| Potassium Iodide | 1.5 mg |
| Hydroxylamine Sulfate | 2.4 g |
| 4-(N-Ethyl-N-β-hydroxyethylamino)-2-methyleniline Sulfate | 4.5 g |
| Water to make | 1.0 l |
| pH | 10.05 |

Bleaching Solution

| | |
|---|---|
| Ammonium Iron (III) Ethylenediamine-tetraacetate Dihydrate | 120.0 g |
| Disodium Ethylenediaminetetraacetate | 10.0 g |
| Ammonium Bromide | 100.0 g |
| Ammonium Nitrate | 10.0 g |
| Bleach Accelerating Agent | 0.005 ml |

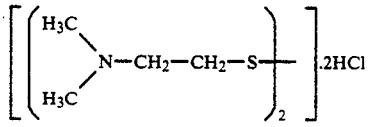

| | |
|---|---|
| Aqueous Ammonia (27%) | 15.0 ml |
| Water to make | 1.0 l |
| pH | 6.3 |

Bleach-Fixing Solution

| | |
|---|---|
| Ammonium iron(III) Ethylenediamine tetraacetate Dihydrate | 50.0 g |
| Disodium Ethylenediaminetetraacetate | 5.0 g |
| Sodium Sulfite | 12.0 g |
| Ammonium Thiosulfate (70% aq. soln.) | 240.0 ml |
| Aqueous Ammonia (27%) | 6.0 ml |
| Water to make | 1.0 l |
| pH | 7.2 |

Washing Water

City water was passed through a mixed bed type column filled with an H type strong acidic cation exchange resin (Amberlite IR-120B manufactured by Rohm & Haas Co.) and an OH type anion exchange resin (Amberlite IR-400 manufactured by Rohm & Haas Co.) to prepare water containing not more than 3 mg/l of calcium ion and magnesium ion. To the water thus-treated were added sodium dichloroisocyanurate in an amount of 20 mg/l and sodium sulfate in an amount of 0.15 g/l. The pH of the solution was in a range from 6.5 to 7.5.

Stabilizing Solution

| | |
|---|---|
| Formaldehyde (37%) | 2.0 ml |
| Polyoxyethylene-p-monononylphenylether (average degree of polymerization: 10) | 0.3 g |
| Disodium Ethylenediaminetetraacetate | 0.05 g |
| Water to make | 1.0 l |
| pH | 5.8 to 8.0 |

EXAMPLE 3

Samples 201 to 214 prepared as in Example 2 were exposed to white light through a step wedge and subjected to development processing according to the processing steps shown below to prepare two sets of samples.

One set of processed samples was allowed to stand at 80° C. for 2 weeks to conduct a color fading test, and another set of processed samples was subjected to a color fading test using a xenon color fading tester sample was measured at a portion having a cyan density of 1.0. The extent of a subsidiary absorption was (75,000 Lux, 1 week). The cyan density ($D_R$) after the color fading test at the point having cyan density of 1.0 before the color fading test was measured, and using the value a dye remaining rate was determined using the following formula, thereby the color image fasteners of each sample was evaluated.

$$\text{Dye Remaining Rate} = \frac{(D_R)}{1.0} \times 100$$

The results obtained are shown in Table 2 below.

| Processing Step | Time | Temperature (°C.) |
|---|---|---|
| First Development | 6 minutes | 38 |
| Washing with Water | 2 minutes | 38 |
| Reversal | 2 minutes | 38 |
| Color Development | 6 minutes | 38 |
| Controlling | 2 minutes | 38 |
| Bleaching | 6 minutes | 38 |
| Fixing | 4 minutes | 38 |
| Washing with Water | 4 minutes | 38 |
| Stabilizing | 1 minute | normal temperature |
| Drying | | |

The composition of each processing solution used is illustrated below.

First Developing Solution

| | |
|---|---|
| Water | 700 ml |
| Pentasodium Nitrilo-N,N,N-trimethylene-phosphonate | 2 g |
| Sodium Sulfite | 20 g |
| Hydroquinonemonosulfonate | 30 g |
| Sodium Carbonate (monohydrate) | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% aq. soln.) | 2 ml |
| Water to make | 1000 ml |
| pH | 9.60 |

Reversal Solution

| | |
|---|---|
| Water | 700 ml |
| Pentasodium Nitrilo-N,N,N-trimethylene-phosphonate | 3 g |
| Stannous Chloride (dihydrate) | 1 g |
| p-Aminophenol | 0.1 g |
| Sodium Hydroxide | 8 g |
| Glacial Acetic Acid | 15 ml |
| Water to make | 1000 ml |
| pH | 6.0 |

Color Developing Solution

| | |
|---|---|
| Water | 700 ml |
| Pentasodium Nitrilo-N,N,N-trimethylene-phosphonate | 3.0 g |
| Sodium Sulfite | 7 g |
| Sodium Tertiary Phosphate (12 hydrate) | 36 g |
| Potassium Bromide | 1 g |
| Potassium Iodide (0.1% aq. soln.) | 90 ml |
| Sodium Hydroxide | 3 g |
| Citrazinic Acid | 1.5 g |
| N-Ethyl-N-(β-methanesulfonamidoethyl)-3-methyl-4-aminoaniline Sulfate | 11 g |
| 3,6-Dithiaoctane-1,8-diol | 1 g |
| Water to make | 1000 ml |
| pH | 11.80 |

Controlling Solution

| | |
|---|---|
| Water | 700 ml |
| Sodium Sulfite | 12 g |
| Sodium Ethylenediaminetetraacetate (dihydrate) | 8 g |
| Thioglycerol | 0.4 ml |
| Glacial Acetic Acid | 3 ml |
| Water to make | 1000 ml |
| pH | 6.0 |

Bleaching Solution

| | |
|---|---|
| Water | 800 ml |
| Sodium Ethylenediaminetetraacetate (dihydrate) | 2 g |
| Ammonium Ethylenediaminetetraacetato ferrate (III) (dihydrate) | 120 g |
| Potassium Bromide | 100 g |
| Water to make | 1000 ml |
| pH | 5.70 |

Fixing Solution

| | |
|---|---|
| Water | 800 ml |
| Sodium Thiosulfate | 80.0 g |
| Sodium Sulfite | 5.0 g |
| Sodium Bisulfite | 5.0 g |
| Water to make | 1000 ml |
| pH | 6.0 |

Stabilizing Solution

| | |
|---|---|
| Water | 800 ml |
| Formaldehyde (37 wt % aq. soln.) | 5.0 ml |
| Fuji Drywel (surface active agent, manufactured by Fuji Photo Film Co., Ltd.) | 5.0 ml |
| Water to make | 1000 ml |
| pH | 7.0 |

TABLE 2

| | | Color Image Fastness | | |
|---|---|---|---|---|
| Sample No. | Coupler | Heat | Light | Remarks |
| 201 | ExC | 74 | 80 | Comparison |
| 202 | I-16) | 96 | 91 | Present Invention |
| 203 | I-20) | 95 | 90 | " |
| 204 | I-21) | 95 | 90 | " |
| 205 | I-28) | 96 | 91 | " |
| 206 | I-31) | 95 | 91 | " |
| 207 | I-32) | 96 | 91 | " |
| 208 | II-9) | 94 | 89 | " |
| 209 | II-10) | 94 | 87 | " |
| 210 | II-11) | 94 | 89 | " |
| 211 | II-13) | 94 | 90 | " |

TABLE 2-continued

| Sample No. | Coupler | Color Image Fastness Heat | Light | Remarks |
|---|---|---|---|---|
| 212 | II-18) | 95 | 90 | " |
| 213 | II-19) | 94 | 90 | " |
| 214 | II-20) | 95 | 88 | " |

As is apparent from the results shown in Table 2 above, the couplers according to the present invention form color images fast to heat and light as compared with the comparative coupler.

EXAMPLE 4

Using the samples subjected to the development processing in Example 1 the spectral absorption of each sample was measured at a portion having a cyan density of 1.0. The extent of a subsidiary absorption was determined using the following formula, thereby the hue of each sample was evaluated.

$$\text{Extent of Subsidiary Absorption} = \frac{\text{Absorption Density at 425 nm}}{\text{Absorption Density at Maximum Absorption Wavelength}}$$

The results are shown in Table 3 below.

TABLE 3

| Sample No. | Coupler | Extent of Subsidiary Absorption | Remarks |
|---|---|---|---|
| 101 | Ex-C | 0.155 | Comparison |
| 102 | I-16) | 0.035 | Present Invention |
| 103 | I-20) | 0.037 | " |
| 104 | I-21) | 0.038 | " |
| 105 | I-28) | 0.033 | " |
| 106 | I-31) | 0.033 | " |
| 107 | I-32) | 0.034 | " |
| 108 | II-9) | 0.040 | " |
| 109 | II-10) | 0 041 | " |
| 110 | II-11) | 0.040 | " |
| 111 | II-13) | 0.042 | " |
| 112 | II-18) | 0.037 | " |
| 113 | II-19) | 0.038 | " |
| 114 | II-20) | 0.039 | " |

As can be seen from the results shown in Table 3 above, the couplers according to the present invention form excellent dyes with little subsidiary absorption on the shorter wavelength side. Accordingly, when the cyan coupler according to the present invention is used in a multilayer color photographic light-sensitive material, it is expected that color reproducibility is improved.

EXAMPLE 5

A paper support, both surfaces of which were laminated with polyethylene, was subjected to a corona discharge treatment and provided with a gelatin subbing layer containing sodium dodecylbenzenesulfonate, and then the photographic layers as shown below were coated to prepare a multilayer color printing paper. The coating solutions were prepared in the following manner.

Preparation of Coating Solution for Fifth Layer 32.0 g of Cyan coupler (ExC), 3.0 g of Dye Image Stabilizer (Cpd-2), 2.0 g of Dye Image Stabilizer (Cpd-4), 18.0 g of Dye Image Stabilizer (Cpd-6), 40.0 g of Dye Image Stabilizer (Cpd-7) and 5.0 g of Dye Image Stabilizer (Cpd-8) were dissolved in 50.0 ml of ethyl acetate and 14.0 g of Solvent (Solv-6) and the resulting solution was added to 500 ml of a 20% aqueous solution of gelatin containing 8 ml of sodium dodecylbenzenesulfonate. The mixture was emulsified and dispersed using an ultrasonic homogenizer to prepare an emulsified dispersion. Separately, to a silver chlorobromide emulsion (cubic grains, mixture of large grain size emulsion (average grain size of 0.58 μm) and small grain size emulsion (average grain size of 0.45 μm) in 1:4 by molar ratio of silver, coefficient of variation of grain size: 0.09 and 0.11, respectively, 0.6 mol % silver bromide based on the silver halide of each emulsion being localized at a part of the surface of grains respectively) were added Red-Sensitive Sensitizing Dye E shown below in an amount of $0.9\times10^{-4}$ mol per mol of silver in case of the large grain size emulsion and in an amount of $1\times10^{-4}$ mol per mol of silver in case of the small grain size emulsion. The emulsion was chemically ripened by adding a sulfur sensitizer and a gold sensitizer. The above described emulsified dispersion was mixed with the red-sensitive silver chlorobromide emulsion, with the amount of the resulting mixture being controlled to form the composition shown below, whereby a coating solution for the Fifth Layer was prepared.

Coating solutions for the First Layer to the Fourth Layer, the Sixth Layer and the Seventh Layer were prepared in a similar manner as described for the coating solution for the Fifth Layer.

1-Oxy-3,5-dichloro-s-triazine sodium salt was used as a gelatin hardener in each layer.

Further, Cpd-10 and Cpd-11 were added to each layer in the total amounts of 25.0 mg/m$^2$ and 50.0 mg/m$^2$, respectively.

The following spectral sensitizing dyes were employed in the silver chlorobromide emulsions in the light-sensitive emulsion layers, respectively.

Blue-Sensitive Emulsion Layer

Sensitizing Dye A

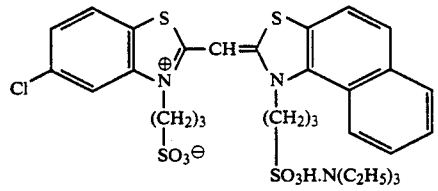

and

Sensitizing Dye B

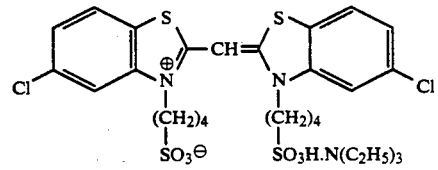

(Amount added: each $2.0\times10^{-4}$ mol per mol of silver halide in the large grain size emulsion and each $2.5\times10^{-4}$ mol per mol of silver halide in the small grain size emulsion)

Green-Sensitive Emulsion Layer:

Sensitizing Dye C

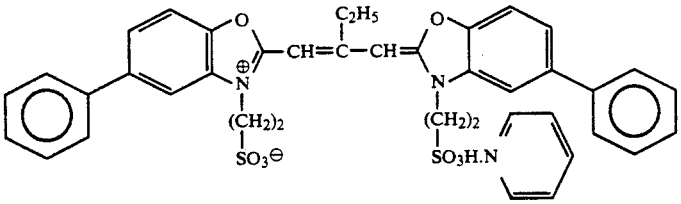

(Amount added: $4.0\times10^{-4}$ mol per mol of silver halide in the large grain size emulsion and $5.6\times10^{-4}$ mol per mol of silver halide in the small grain size emulsion) and Sensitizing Dye D

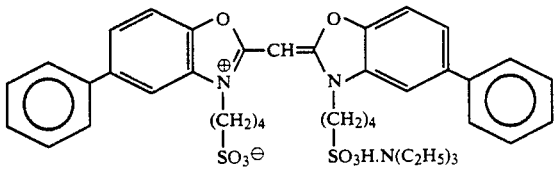

(Amount added: $7.0\times10^{-5}$ mol per mol of silver halide in the large grain size emulsion and $1.0\times10^{-5}$ mol per mol of silver halide in the small grain size emulsion)

Red-Sensitive Emulsion Layer

Sensitizing Dye E

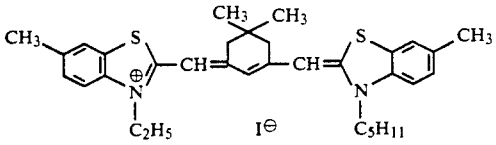

(Amount added: $0.9\times10^{-4}$ mol per mol of silver halide in the large grain size emulsion and $1.1\times10^{-3}$ mol per mol of silver halide in the small grain size emulsion)

To the red-sensitive emulsion layer, was added the compound shown below in an amount of $2.6\times10^{-3}$ mol per mol of silver halide.

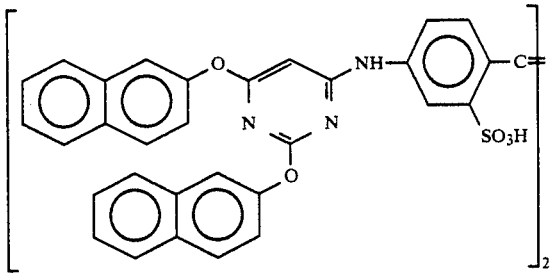

To the blue-sensitive emulsion layer, green-sensitive emulsion layer and the red-sensitive the emulsion layer, was added 1-(5-methylureidophenyl)-5-mercaptotetrazole in amounts of $8.5\times10^{-5}$ mol, $7.7\times10^{-4}$ mol and $2.5\times10^{-4}$ mol per mol of silver halide, respectively.

Further, to the blue-sensitive emulsion layer and athe green-sensitive emulsion layer, was added 4-hydroxy-6-methyl-1,3,3a,7-tetraazaindene in amounts of $1\times10^{-4}$ mol and $2\times10^{-4}$ mol per mol of silver halide, respectively.

Moreover, in order to prevent irradiation, the following dyes were added to the emulsion layers. The coating amounts thereof are shown in parentheses.

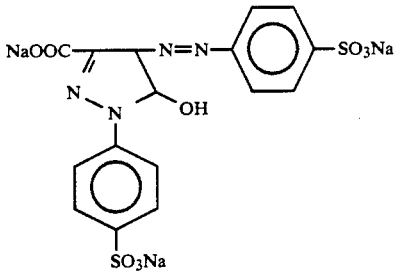

(10 mg/m²)

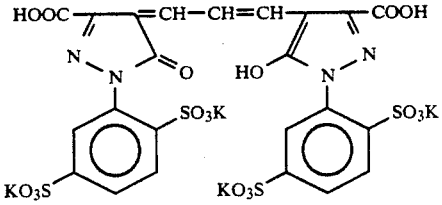

(10 mg/m²)

-continued

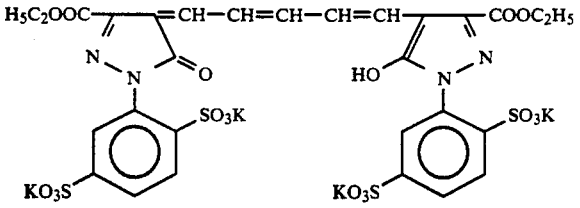

(40 mg/m²)

and

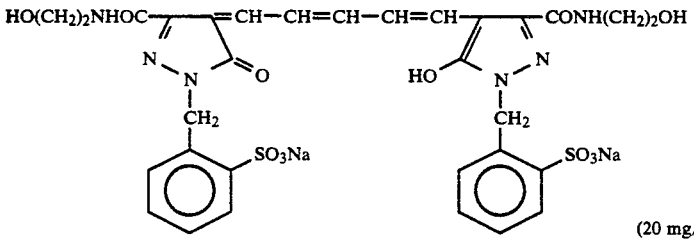

(20 mg/m²)

Layer Construction

The composition of each layer is shown below. The numerical values are the coating amounts of components in units of g/m². The coating amount of the silver halide emulsion is shown in terms of the silver coating amount.

| | |
|---|---|
| Support | |
| Polyethylene Laminated Paper (the polyethylene coating contained a white pigment ($TiO_2$) and a bluish dye (ultramarine) on the First Layer side) | |
| First Layer (Blue-sensitive layer) | |
| Ag in Silver Chlorobromide Emulsion (cubic grains, mixture of large grain size emulsion (average grain size of 0.88 μm) and small grain size emulsion (average grain size of 0.70 μm) in 3:7 by molar ratio of silver, coefficient of variation of grain size: 0.08 and 0.10, respectively, 0.3 mol % silver bromide based on the wholeof grains being localized at a part of the surface of grains, respectively) | 0.30 |
| Gelatin | 1.22 |
| Yellow Coupler (ExY) | 0.82 |
| Dye Image Stabilizer (Cpd-1) | 0.19 |
| Solvent (Solv-3) | 0.18 |
| Solvent (Solv-7) | 0.18 |
| Dye Image Stabilizer (Cpd-7) | 0.06 |
| Second Layer (Color mixing preventing layer) | |
| Gelatin | 0.64 |
| Color Mixing Preventing Agent (Cpd-5) | 0.10 |
| Solvent (Solv-1) | 0.16 |
| Solvent (Solv-4) | 0.08 |
| Third Layer (Green-sensitive layer) | |
| Ag in Silver Chlorobromide Emulsion (cubic grains, mixture of large grain size emulsion (average grain size of 0.55 μm) and small grain size emulsion (average grain size of 0.39 μm) in 1:3 by molar ratio of silver, coefficient of variation of grain size: 0.10 and 0.08, respectively, 0.8 mol % silver bromide based on the grains being localized at a part of the surface of grains respectively) | 0.12 |
| Gelatin | 1.28 |
| Magenta Coupler (ExM) | 0.23 |
| Dye Image Stabilizer (Cpd-2) | 0.03 |
| Dye Image Stabilizer (Cpd-3) | 0.16 |
| Dye Image Stabilizer (Cpd-4) | 0.02 |
| Dye image stabilizer (Cpd-9) | 0.02 |
| Solvent (Solv-2) | 0.40 |
| Fourth Layer (Ultravioler light absorbing layer) | |
| Gelatin | 1.41 |
| Ultraviolet Light Absorbing agent (UV-1) | 0.47 |
| Color Mixing Preventing Agent (Cpd-5) | 0.05 |
| Solvent (Solv-5) | 0.24 |
| Fifth Layer (Red-sensitive layer) | |
| Ag in Silver Chlorobromide Emulsion (cubic grains, mixture of large grain size emulsion (average grain size of 0.58 μm) and small grain size emulsion (average grain size of 0.45 μm) in 1:4 by molar ratio of silver, coefficient of variation of grain size: 0.09 and 0.11, respectively, 0.6 mol % silver bromide based on the grains being localized at a part of the surface of grains, respectively) | 0.23 |
| Gelatin | 1.04 |
| Cyan Coupler (ExC) | 0.24 |
| Dye Image Stabilizer (Cpd-2) | 0.03 |

-continued

| | |
|---|---|
| Dye Image Stabilizer (Cpd-4) | 0.02 |
| Dye Image Stabilizer (Cpd-6) | 0.18 |
| Dye Image Stabilizer (Cpd-7) | 0.40 |
| Dye Image Stabilizer (Cpd-8) | 0.05 |
| Solvent (Solv-6) | 0.14 |
| Sixth Layer (Ultraviolet light absorbing layer) | |
| Gelatin | 0.48 |
| Ultraviolet Light Absorbing agent (UV-1) | 0.16 |
| Color Mixing Preventing Agent (Cpd-5) | 0.02 |
| Solvent (Solv-5) | 0.08 |
| Seventh Layer (Protective layer) | |
| Gelatin | 1.10 |
| Acryl-Modified Polyvinyl Alcohol Copolymer (Degree of modification: 17%) | 0.17 |
| Liquid paraffin | 0.03 |

Yellow Coupler (ExY)
1:1 (by mole) mixture of

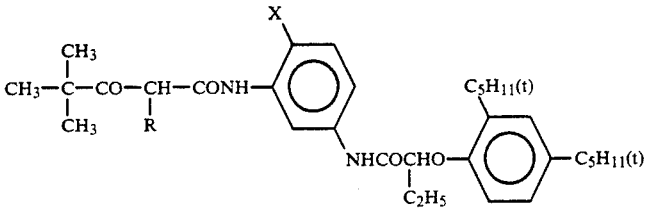

R =

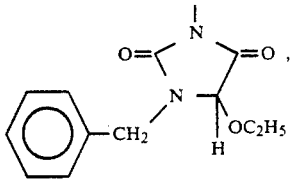

, X = Cl and

R =

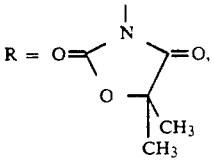

, X = $OCH_3$

Magenta Coupler (ExM)

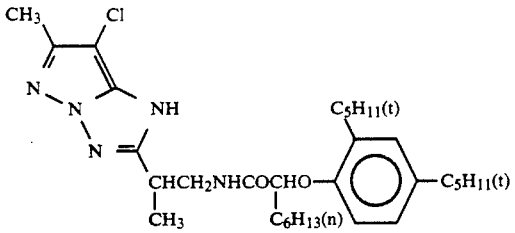

Cyan Coupler (ExC)
1:1 (by mole) mixture of

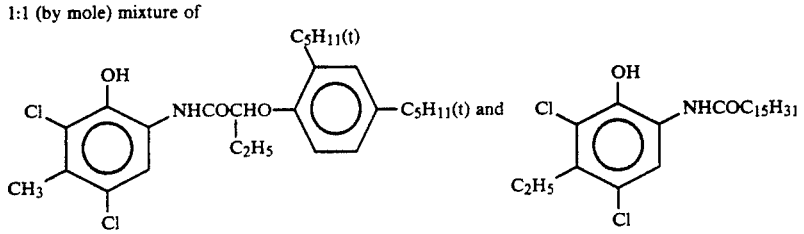

Dye Image Stabilizer (Cpd-1)

-continued
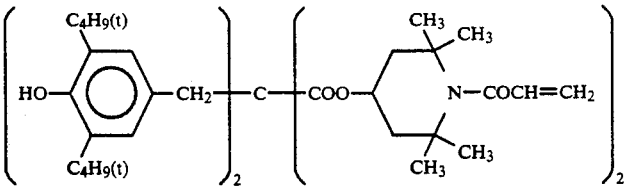
Dye Image Stabilizer (Cpd-2)
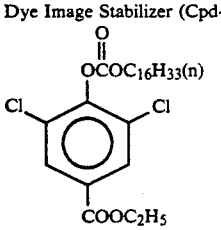
Dye Image Stabilizer (Cpd-3)
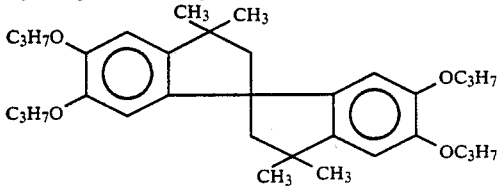
Dye Image Stabilizer (Cpd-4)
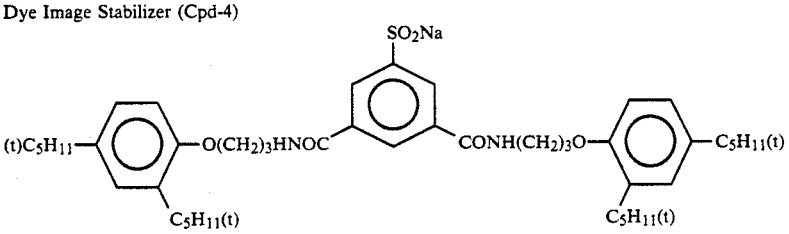
Color Mixing Inhibitor (Cpd-5)
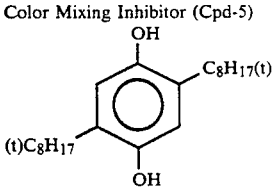
Dye Image Stabilizer (Cpd-6)
2:4:4 (by weight) mixture of
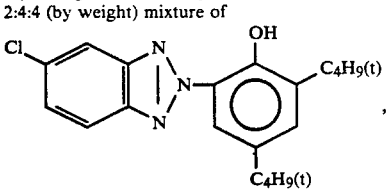
,
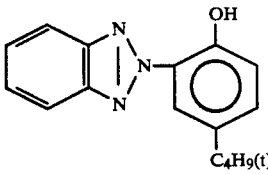
, and
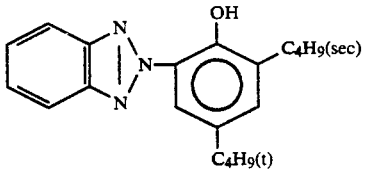
Dye Image Stabilizer (Cpd-7)
$\left(CH_2-\underset{\underset{CONHC_4H_9(t)}{|}}{CH}\right)_n$ Average Molecular Weight 60,000
Dye Image Stabilizer (Cpd-8)

-continued
1:1 (by weight) mixture of
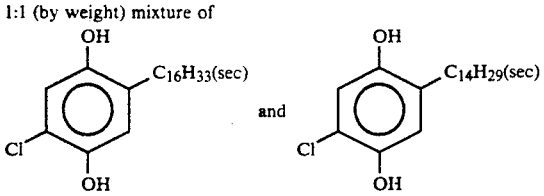
Dye Image Stabilizer (Cpd-9)
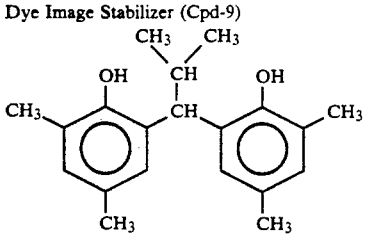
Antiseptic (Cpd-10)
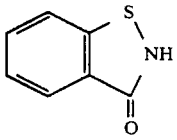
Antiseptic (Cpd-11)
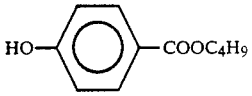
Ultraviolet Absorber (UV-1)
4:2:4 (by weight) mixture of
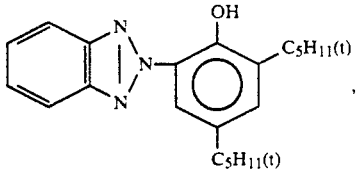
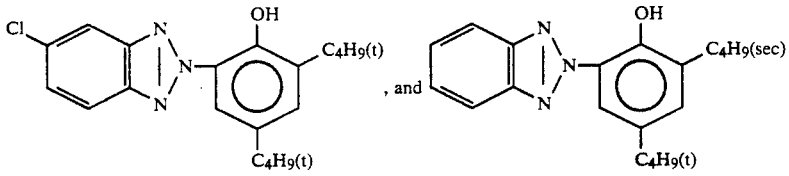
Solvent (Solv-1)
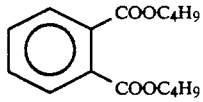
Solvent (Solv-2)
1:1 (by volume) mixture of
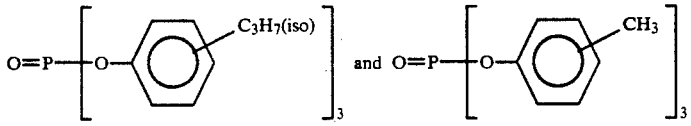
Solvent (Solv-3)
$O{=}P{+}O{-}C_9H_{19}(iso)]_3$
Solvent (Solv-4)

-continued

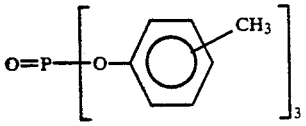

Solvent (Solv-5)

$COOC_8H_{17}$
|
$(CH_2)_8$
|
$COOC_8H_{17}$

Solvent (Solv-6)
80:20 (by volume) mixture of

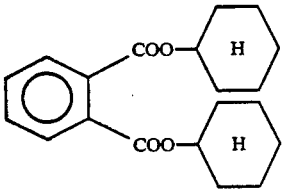

and $C_8H_{17}CH(O)CH(CH_2)_7COOC_8H_{17}$

Solvent (Solv-7)
$C_8H_{17}CH(O)CH(CH_2)_7COOC_8H_{17}$

Light-sensitive materials were prepared in the same manner as described above except for using an equimolar amount of each of the cyan couplers shown in Table 4 below in place of the cyan coupler used in the Fifth Layer respectively.

Each of the samples thus-prepared was subjected to wedge exposure through a three color separating filter for sensitometry using a sensitometer (FWH type, produced by Fuji Photo Film Co., Ltd.) equipped with a light source having a color temperature of 3,200° K. The amount of exposure was 250 CMS and the exposure time was 0.1 second.

Each exposed sample was subjected to a continuous processing (running test) with a paper processor according to the processing steps described below until the amount of replenishment for color development reached twice the volume of the tank capacity of color development.

| Processing Step | Temperature (°C.) | Time | Amount of Replenishment* (ml) | Tank Capacity (l) |
|---|---|---|---|---|
| Color Development | 35 | 45 sec. | 161 | 17 |
| Bleach-Fixing | 30–35 | 45 sec. | 215 | 17 |
| Rinse (1) | 30–35 | 20 sec. | — | 10 |
| Rinse (2) | 30–35 | 20 sec. | — | 10 |
| Rinse (3) | 30–35 | 20 sec. | 350 | 10 |
| Drying | 70–80 | 60 sec. | | |

*Amount of replenishment per $m^2$ of photographic light-sensitive material

The rinse steps were conducted using a three-tank countercurrent system from Rinse (3) to Rince (2), and from Rinse (2) to Rinse (1).

The composition of each processing solution used is illustrated below.

Color Developing Solution

| | Tank Solution | Replenisher |
|---|---|---|
| Water | 800 ml | 800 ml |
| Ethylenediamine-N,N,N,N-tetramethylenephosphonic Acid | 1.5 g | 2.0 g |
| Potassium Bromide | 0.015 g | — |
| Triethanolamine | 8.0 g | 12.0 g |
| Sodium Chloride | 1.4 g | — |
| Potassium Carbonate | 25 g | 25 g |
| N-Ethyl-N-(β-methanesulfonamidoethyl)-3-methyl-4-aminoaniline Sulfate | 5.0 g | 7.0 g |
| N,N-bis(Carboxymethyl)hydrazine | 4.0 g | 5.0 g |
| N,N-Di(sulfoethyl)hydroxylamine Monosodium Salt | 4.0 g | 5.0 g |
| Fluorescent Brightening Agent (WHITEX 4B manufactured by Sumitomo Chemical Co., Ltd.) | 1.0 g | 2.0 g |
| Water to make | 1000 ml | 1000 ml |
| pH (at 25° C.) | 10.05 | 10.45 |

Bleach-Fixing Solution (both tank solution and replenisher)

| | |
|---|---|
| Water | 400 ml |
| Ammonium Thiosulfate (70% aq. soln.) | 100 ml |
| Sodium Sulfite | 17 g |
| Ammonium Iron(III) Ethylenediaminetetraacetate | 55 g |
| Disodium Ethylenediaminetetraacetate | 5 g |
| Ammonium Bromide | 40 g |
| Water to make | 1000 ml |
| pH (at 25° C.) | 6.0 |

Rinse Solution: (both tank solution and replenisher)

Ion-exchange water (calcium and magnesium contents: not more than 3 ppm respectively)

The cyan reflection density of each of the samples thus processed was measured with a (Fuji type densitometer (F.S.D)). The photographic properties were determined using the minimum density ($D_{min}$) and the maximum density ($D_{max}$).

Further each sample whose cyan reflection density was measured just after the development processing was stored under conditions of 80° C. and 30% RH for one month and then the cyan reflection density was again measured to determine the decrease in cyan density at the point having an initial cyan reflection density of 1.5. A fading ratio was calculated as follows.

$$\text{Fading Ratio} = \frac{D}{1.5} \times 100$$

D: reflection density at the point with a fresh density of 1.5 after storage at 80° C. and 30% RH for one month.

The results obtained are shown in Table 4 below.

TABLE 4

| Light-Sensitive Material | Cyan Coupler | Color Forming Properties $D_{min}$ | $D_{max}$ | Fading Ratio (%) | Remarks |
|---|---|---|---|---|---|
| A | ExC | 0.12 | 1.92 | 51 | Comparison |
| B | II-17) | 0.12 | 2.30 | 92 | Present Invention |
| C | II-18) | 0.12 | 2.30 | 94 | " |
| D | II-19) | 0.12 | 2.15 | 90 | " |
| E | II-20) | 0.12 | 2.28 | 93 | " |
| F | II-32) | 0.12 | 2.30 | 94 | " |
| G | II-40) | 0.12 | 2.31 | 95 | " |
| H | II-37) | 0.12 | 2.35 | 93 | " |
| I | I-23) | 0.12 | 2.29 | 92 | " |
| J | I-30) | 0.12 | 2.26 | 94 | " |

It can be seen from the results shown in Table 4 that high color density can be obtained and fading of the cyan color image during storage after processing is remarkably restrained by using the cyan coupler according to the present invention.

The 1H-pyrrolo[2,1-c][1,2,4]triazole cyan couplers according to the present invention have excellent color forming property, color reproducibility and image preservability in comparison with known cyan couplers.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one red-sensitive silver halide emulsion layer containing at least one 1H-pyrrolo(2,1-c) (1,2,4)triazole cyan coupler represented by the following general formula (I) or (II):

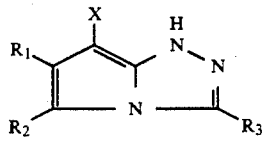

(I)

-continued

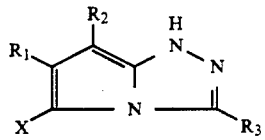

(II)

wherein $R_1$ and $R_2$ each is an electron withdrawing group which has a Hammett's substituent constant $\sigma p$ value of 0.15 to 1.0; $R_1$ and $R_2$ may be bonded to form a ring; $R_3$ represents an alkyl group, an aryl group, a cyano group, a carboxyl group, an amino group, an alkylamino group, an anilino group, a carbamoyl group, a sulfamoyl group, an alkoxycarbonyl group, an aryloxycarbonyl group, an acyl group or a thiocyanate group, and X represents a hydrogen atom or a substituent capable of being released upon coupling with an oxidation product of an aromatic primary amine color developing agent; said coupler may form a bis-compound or a polymer at $R_1$, $R_2$, $R_3$ or X.

2. A silver halide color photographic material as claimed in claim 1, wherein the Hammett's substituent constant $\sigma p$ value is 0.20 to 1.0.

3. A silver halide color photographic material as claimed in claim 2, wherein the electron withdrawing substituent has a Hammett's substituent constant $\sigma p$ value of 0.20 to 1.0 and is an acyl group, an acyloxy group, a carbamoyl group, an alkoxycarbonyl group, an aryloxycarbonyl group, a cyano group, nitro group, a dialkylphosphono group, a diarylphosphono group, a diarylphosphinyl group, an alkylsulfinyl group, an arylsulfinyl group, an alkylsulfonyl group, an arylsulfonyl group, an alkyloxysulfonyl group, an aryloxysulfonyl group, an acylthio group, a sulfamoyl group, a thiocyanate group, an alkyl- or aryl-thiocarbonyl group, a halogenated alkyl group, a halogenated alkoxy group, a halogenated aryloxy group, a halogenated alkylamino group, a halogenated alkylthio group, an aryl group substituted with other electron withdrawing group having an $\sigma p$ value of not less than 0.20, a heterocyclic group, a chlorine atom, a bromide atom, an alkyl- or aryl-azo group or a selenocyanate group; these substituents may further have at least one substituent selected from a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, an alkyo- or aryl-sulfonamido group, a carbamoyl group, a sulfamoyl group, an alkyl- or aryl-sulfonyl group, an alkyl- or aryl-sulfonyloxy group, an alkoxycarbonyl group, a heterocyclic oxy group, an alkyl- or aryl-azo group, an alkyl- or aryl-oxysulfonyl group, an acyloxy group, a carbamoyloxy group, a silyloxy group, an aryloxycarbonylamino group, an imido group, a selenocyanate group, a heterocyclic thio group, an alkyl- or aryl-sulfinyl group, a phosphinyl group, a phosphonyl group, a phosphono group, an aryloxycarbonyl group, an acyl group, an acylthio group, an azolyl group, an isocyanate, a thiocyanate group and an alkyl- or aryl-thiocarbonyl group.

4. A silver halide color photographic material as claimed in claim 1, wherein the Hammett's substituent constant $\sigma p$ value is 0.30 to 1.0.

5. A silver halide color photographic material as claimed in claim 4, wherein the electron withdrawing substituent has a Hammett's substituent constant σp value of 0.30 to 1.0 and is an acyl group, an acyloxy group, a carbamoyl group an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, halogenated alkyl group, a halogenated alkoxy group, a halogenated aryloxy group, a halogenated alkylthio group, an aryl group substituted with two or more other electron withdrawing substituents each having a Hammett's substituent constant σp value of 0.15 or more or a heterocyclic group; these substituents may further have at least one substituent selected from a halogen atom, an alkyl group, an aryl group, a heterocyclic group, a cyano group, a hydroxy group, a nitro group, a carboxy group, sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, an alkyo- or aryl-sulfonamido group, a carbamoyl group, a sulfamoyl group, an alkyl- or aryl-sulfonyl group, an alkyl- or aryl-sulfonyloxy group, an alkoxycarbonyl group, a heterocyclic oxy group, an alkyl- or aryl-azo group, an alkyl- or aryl-oxysulfonyl group, an acyloxy group, a carbamoyloxy group, a silyloxy group, an aryloxycarbonylamino group, an imido group, a selenocyanate group, a heterocyclic thio group, an alkyl- or aryl-sulfinyl group, a phosphinyl group, a phosphonyl group, a phosphono group, n aryloxycarbonyl group, an acyl group, an acylthio group, an azolyl group, an isocyanate, a thiocyanate group and an alkyl- or aryl-thiocarbonyl group.

6. A silver halide color photographic material as claimed in claim 1, wherein the Hammett's substituent constant σp value is 0.60 to 1.0.

7. A silver halide color photographic material as claimed in claim 6, wherein the electron withdrawing substituent has a Hammett's substituent constant σp value of 0.60 to 1.0 and is a cyano group, a nitro group or an alkylsulfonyl group which may be further substituted with at least one substituent selected from a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, an alkyo- or aryl-sulfonamido group, a carbamoyl group, a sulfamoyl group, an alkyl- or aryl-sulfonyl group, an alkyl- or aryl-sulfonyloxy group, an alkoxycarbonyl group, a heterocyclic oxy group, an alkyl- or aryl-azo group, an alkyl- or aryl-oxysulfonyl group, an acyloxy group, a carbamoyloxy group, a silyloxy group, an aryloxycarbonylamino group, an imido group, a selenocyanate group, a heterocyclic thio group, an alkyl- or aryl-sulfinyl group, a phosphinyl group, a phosphonyl group, a phosphono group, an aryloxycarbonyl group, an acyl group, an acylthio group, an azolyl group, an isocyanate, a thiocyanate group and an alkyl- or aryl-thiocarbonyl group.

8. A silver halide color photographic material as claimed in claim 1, wherein the Hammett's substituent constant σp value is 1.0 or less.

9. A silver halide color photographic material as claimed in claim 1, wherein the sum of the Hammett's substituent constant σp values of the electron withdrawing substituents represented by $R_1$ and $R_2$ is 1.8 or less.

10. A silver halide color photographic material as claimed in claim 1, wherein the electron withdrawing substituent having a Hammett's substituent constant σp value of 0.15 to 1.0 is an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, an alkylthio group, an arylthio group, an alkyl or aryl-oxysulfonyl group, an acylthio group, a sulfamoyl group, an isocyanate group, a thiocyanate group, an alkyl- or aryl-thiocarbonyl group, a halogenated alkyl group, a halogenated alkoxy group, a halogenated aryloxy group, a halogenated alkylamino group, a halogenated alkylthio group, a substituted aryl group, a heterocyclic group, a chlorine atom, a bromine atom, an alkyl- or aryl-azo group or a selenocyanate group; these substituents may further have at least one substituent selected from a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, an alkyo- or aryl-sulfonamido group, a carbamoyl group, a sulfamoyl group, an alkyl- or aryl-sulfonyl group, an alkyl- or aryl-sulfonyloxy group, an alkoxycarbonyl group, a heterocyclic oxy group, an alkyl- or aryl-azo group, an alkyl- or aryl-oxysulfonyl group, an acyloxy group, a carbamoyloxy group, a silyloxy group, an aryloxycarbonylamino group, an imido group, a selenocyanate group, a heterocyclic thio group, an alkyl- or aryl-sulfinyl group, a phosphinyl group, a phosphonyl group, a phosphono group, an aryloxycarbonyl group, an acyl group, an acylthio group, an azolyl group, an isocyanate, a thiocyanate group and an alkyl- or aryl-thiocarbonyl group.

11. A silver halide color photographic material as claimed in claim 1, wherein the 1H-pyrrolo[2,1-c][1,2,4]-triazole cyan coupler is contained in an amount of $1\times10^{-3}$ to 1 mol per mol of light-sensitive silver halide.

12. A silver halide color photographic material as claimed in claim 1, wherein the 1H-pyrrolo[2,1-c][1,2,4]-triazole cyan coupler is capable of forming a cyan dye having a maximum wavelength in the range of from 600 to 700 nm.

13. A cyan image forming method comprising imagewise exposing a silver halide color photographic material comprising a support having thereon at least one light-sensitive silver halide emulsion layer and subjecting the exposed photographic material to color development with an aromatic primary amine color developing agent in the presence of an 1H-pyrrolo(2,1-c)(1,2,4)triazole cyan coupler represented by the general formula (I) or (II):

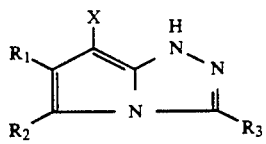

(I)

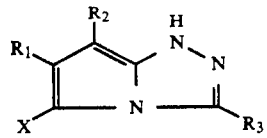

(II)

wherein $R_1$ and $R_2$ each represents a hydrogen atom or a substituent, provided that $R_1$ and $R_2$ each is an electron withdrawing group which has a Hammett's substituent constant $\sigma p$ value of 0.15 to 1.0; $R_1$ and $R_2$ may be bonded to form a ring; $R_3$ represents an alkyl group, an aryl group, a cyano group, a carboxyl group, an amino group, an alkylamino group, an anilino group, a carbamoyl group, a sulfamoyl group, an alkoxycarbonyl group, an aryloxycarbonyl group, an acyl group or a thiocyanate group, and X represents a hydrogen atom or a substituent capable of being released upon coupling with an oxidation product of an aromatic primary amine color developing agent; said coupler may form a bis-compound or a polymer at $R_1$, $R_2$, $R_3$ or X.

14. A cyan image forming method as claimed in claim 13, wherein the 1H-pyrrolo[2,1-c][1,2,4]triazole cyan coupler is incorporated in a color developing solution containing the aromatic primary amine color developing agent.

15. A cyan image forming method as claimed in claim 14, wherein the 1H-pyrrolo[2,1-c][1,2,4]triazole cyan coupler is incorporated in a color developing solution in an amount of from 0.0005 to 0.05 mol per liter of the color developing solution.

16. A cyan image forming method as claimed in claim 13, wherein 1H-pyrrolo[2,1-c][1,2,4]triazole cyan coupler is contained in the light-sensitive silver halide emulsion layer.

17. A cyan image forming method as claimed in claim 13, wherein the Hammett's substituent constant $\sigma p$ value is 0.20 to 1.0.

18. A cyan image forming method as claimed in claim 17, wherein the electron withdrawing substituent has a Hammett's substituent constant $\sigma p$ value of 0.20 to 1.0 and is an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, an alkyloxysulfonyl group, an aryloxysulfonyl group, an acylthio group, a sulfamoyl group, a thiocyanate group, an alkyl- or aryl-thiocarbonyl group, a halogenated alkyl group, a halogenated alkoxy group, a halogenated aryloxy group, a halogenated alkylamino group, a halogenated alkylthio group, an aryl group substituted with other electron withdrawing group having the $\sigma p$ value of not less than 0.20, and a heterocyclic group, a chlorine atom, a bromine atom, an alkyl- or aryl-azo group or a selenocyanate group; these substituents may further have at least one substituent selected from a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, an alkyo- or aryl-sulfonamido group, a carbamoyl group, a sulfamoyl group, an alkyl- or aryl-sulfonyl group, an alkyl- or aryl-sulfonyloxy group, n alkoxycarbonyl group, a heterocyclic oxy group, an alkyl- or aryl-azo group, an alkyl- or aryl-oxysulfonyl group, an acyloxy group, a carbamoyloxy group, a silyloxy group, an aryloxycarbonylamino group, an imido group, a selenocyanate group, a heterocyclic thio group, an alkyl- or aryl-sulfinyl group, a phosphinyl group, a phosphonyl group, a phosphono group, an aryloxycarbonyl group, an acyl group, an acylthio group, an azolyl group, an isocyanate, a thiocyanate group and an alkyl- or aryl-thiocarbonyl group.

19. A cyan image forming method as claimed in claim 13, wherein the Hammett's substituent constant $\sigma p$ value is 0.30 to 1.0.

20. A cyan image forming method as claimed in claim 13, wherein the Hammett's substituent constant $\sigma p$ value is 0.60 to 1.0.

21. A cyan image forming method as claimed in claim 20, wherein the electron withdrawing substituent has a Hammett's substituent constant $\sigma p$ value of 0.30 to 1.0 and is an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkoxy group, a halogenated aryloxy group, a halogenated alkylthio group, an aryl group substituted with two or more other electron withdrawing substituents each having a Hammett's substituent constant $\sigma p$ value of 0.15 or more or a heterocyclic group; these substituents may further have at least one substituent selected from a halogen atom, an alkyl group, an aryl group, a heterocyclic group, a cyano group, a hydroxy group, a nitro group, a carboxy group, a sulfo group, an amino group, a n alkoxy group, an aryloxy group, an acylamino group, an alkylamino group, an anilino group, a ureido group, a sulfamoylamino group, an alkylthio group, an arylthio group, an alkoxycarbonylamino group, an alkyo- or aryl-sulfonamido group, a carbamoyl group, a sulfamoyl group, an alkyl- or aryl-sulfonyl group, an alkyl- or aryl-sulfonyloxy group, an alkoxycarbonyl group, a heterocyclic oxy group, an alkyl- or aryl-azo group, an alkyl- or aryl- oxysulfonyl group, an acyloxy group, a carbamoyloxy group, a silyloxy group, an aryloxycarbonylamino group, an imido group, a selenocyanate group, a heterocyclic thio group, an alkyl- or aryl-sulfinyl group, a phosphinyl group, a phosphonyl group, a phosphono group, an aryloxycarbonyl group, an acyl group, an acylthio group, an azolyl group, an isocyanate, a thiocyanate group and an alkyl- or aryl-thiocarbonyl group.

22. A cyan image forming method as claimed in claim 20, wherein the electron withdrawing substituent has a Hammett's substituent constant $\sigma p$ value of 0.60 to 1.0 and is a cyano group, a nitro group and an alkylsulfonyl group which may be further substituted with at least one substituent selected from a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, an alkyo- or aryl-sulfonamido group, a carbamoyl group, a sulfamoyl group, an alkyl- or aryl-sulfonyl group, an alkyl- or aryl-sulfonyloxy group, an alkoxycarbonyl group, a heterocyclic oxy group, an alkyl- or aryl-azo group, an alkyl- or aryl-oxysulfonyl group, an acyloxy group, a carbamoyloxy group, a silyloxy group, an aryloxycarbonylamino group, an imido group, a selenocyanate group, a heterocyclic thio group, an alkyl- or aryl-sulfinyl group, a phosphinyl group, a phosphonyl group, a phosphono group, an aryloxycarbonyl group, an acyl group, an acylthio group, an azolyl group, an isocyanate, a thiocyanate group and an alkyl- or aryl-thiocarbonyl group.

23. A cyan image forming method as claimed in claim 13, wherein at least $R_1$ is an electron withdrawing substituent which has a Hammett's substituent constant $\sigma p$ value of 0.15 or more.

24. A cyan image forming method as claimed in claim 13, wherein at least one of $R_1$ and $R_2$ is an electron withdrawing substituent having a Hammett's substituent constant $\sigma p$ value of 0.15 or more and the other of $R_1$ and $R_2$ is an electron withdrawing substituent.

25. A cyan image forming method as claimed in claim 13, wherein $R_1$ and $R_2$ each represents an electron withdrawing substituent having a Hammett's substituent constant $\sigma p$ value of 0.15 or more.

26. A cyan image forming method as claimed in claim 13, wherein $R_1$ and $R_2$ each represents an electron withdrawing substituent having a Hammett's substituent constant $\sigma p$ value of 0.20 or more.

27. A cyan image forming method as claimed in claim 20, wherein the sum of the Hammett's substituent constant $\sigma p$ values of the electron withdrawing substituents represented by $R_1$ and $R_2$ is 0.60 or more.

28. A cyan image forming method as claimed in claim 13, wherein the substituent represented by $R_1$ or $R_2$ is selected from the group consisting of a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, an alkyl- or aryl-sulfonamido group, a carbamoyl group, a sulfamoyl group, an alkyl- or aryl-sulfonyl group, an alkyl- or aryl-sulfonyloxy group, an alkoxycarbonyl group, a heterocyclic oxy group, an alkyl- or aryl-azo group, an alkyl- or aryl-oxysulfonyl group, an acyloxy group, a carbamoyloxy group, a silyloxy group, an aryloxycarbonylamino group, an imido group, a selenocyanate group, a heterocyclic thio group, an alkyl- or aryl-sulfinyl group, a phosphinyl group, a phosphonyl group, a phosphono group, an aryloxycarbonyl group, an acyl group, an acylthio group, an azolyl group, an isocyanate, a thiocyanate group and an alkyl- or aryl-thiocarbonyl group; these groups may be further substituted with at least one of these substituents; $R_1$ and $R_2$ may be bonded to form a ring; and at least one of $R_1$ and $R_2$ is selected from these groups having a $\sigma p$ value of 0.15 or more.

29. A cyan image forming method as claimed in claim 13, wherein the electron withdrawing substituent having a Hammett's substituent constant $\sigma$ value of 0.15 1.0 is an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, an alkylthio group, an arylthio group, an alkyl- or aryl-oxysulfonyl group, an acylthio group, a sulfamoyl group, an isocyanate group, a thiocyanate group, an alkyl- or aryl-thiocarbonyl group, a halogenated alkyl group, a halogenated alkoxy group, a halogenated aryloxy group, a halogenated alkylamino group, a halogenated alkylthio group, a substituted aryl group, a heterocyclic group, a chlorine atom, a bromine atom, an alkyl- or aryl-azo group or a selenocyanate group; these substituents may further have at least one substituent selected from a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, an alkyo- or aryl-sulfonamido group, a carbamoyl group, a sulfamoyl group, an alkyl- or aryl-sulfonyl group, an alkyl- or aryl-sulfonyloxy group, an alkoxycarbonyl group, a heterocyclic oxy group, an alkyl- or aryl-azo group, an alkyl- or aryl-oxysulfonyl group, an acyloxy group, a carbamoyloxy group, a silyloxy group, an aryloxycarbonylamino group, an imido group, a selenocyanate group, a heterocyclic thio group, an alkyl- or aryl-sulfinyl group, a phosphinyl group, a phosphonyl group, a phosphono group, an aryloxycarbonyl group, an acyl group, an acylthio group, an azolyl group, an isocyanate, a thiocyanate group and an alkyl- or aryl-thiocarbonyl group.

30. A cyan image forming method as claimed in claim 13, wherein the 1H-pyrrolo[2,1-c][1,2,4]-triazole cyan coupler is capable of forming a cyan dye having a maximum wavelength in the range of from 600 to 700 nm.

* * * * *